US008103504B2

(12) United States Patent
Ohguri et al.

(10) Patent No.: US 8,103,504 B2
(45) Date of Patent: Jan. 24, 2012

(54) ELECTRONIC APPLIANCE AND VOICE SIGNAL PROCESSING METHOD FOR USE IN THE SAME

(75) Inventors: Hirokazu Ohguri, Kanagawa-ken (JP); Masahiro Kitaura, Kanagawa-ken (JP)

(73) Assignee: Victor Company of Japan, Limited, Yokohama-shi, Kanagawa-ken (JP)

( * ) Notice: Subject to any disclaimer, the term of this patent is extended or adjusted under 35 U.S.C. 154(b) by 905 days.

(21) Appl. No.: 11/892,577

(22) Filed: Aug. 24, 2007

(65) Prior Publication Data

US 2008/0052079 A1 Feb. 28, 2008

(30) Foreign Application Priority Data

Aug. 28, 2006 (JP) ..... P2006-230879
Jul. 2, 2007 (JP) ..... P2007-173784

(51) Int. Cl.
*G10L 13/00* (2006.01)

(52) U.S. Cl. ..... 704/258; 704/246; 704/247; 704/251; 704/252

(58) Field of Classification Search ..... None
See application file for complete search history.

(56) References Cited

U.S. PATENT DOCUMENTS

| | | | | |
|---|---|---|---|---|
| 4,276,802 | A * | 7/1981 | Mieda | 84/700 |
| 4,506,380 | A * | 3/1985 | Matsui | 381/71.9 |
| 6,737,572 | B1 * | 5/2004 | Jameson et al. | 84/741 |
| 2004/0203697 | A1 * | 10/2004 | Finn | 455/420 |

FOREIGN PATENT DOCUMENTS

| | | |
|---|---|---|
| JP | 03-054989 | 3/1991 |
| JP | 03-184497 | 8/1991 |
| JP | 05-31483 | 4/1993 |
| JP | 06-318424 | 11/1994 |

* cited by examiner

*Primary Examiner* — Leonard Saint Cyr
(74) *Attorney, Agent, or Firm* — The Nath Law Group; Jerald L. Meyer; Brooks Gifford

(57) ABSTRACT

An electronic appliance includes a speaker which outputs a first sound wave based on a first voice signal generated from the electronic appliance, and a microphone to detect a second sound wave on which a sound wave generated for control of the electronic appliance is superimposed to output a second voice signal. A first waveform generator generates a first waveform signal based on the first voice signal, and a second waveform generator generates a second waveform signal based on the second voice signal. A waveform shaping unit outputs a third waveform signal in which the first waveform signal is enlarged in a time axis direction, and a subtracter subtracts the third waveform signal from the second waveform signal.

4 Claims, 16 Drawing Sheets

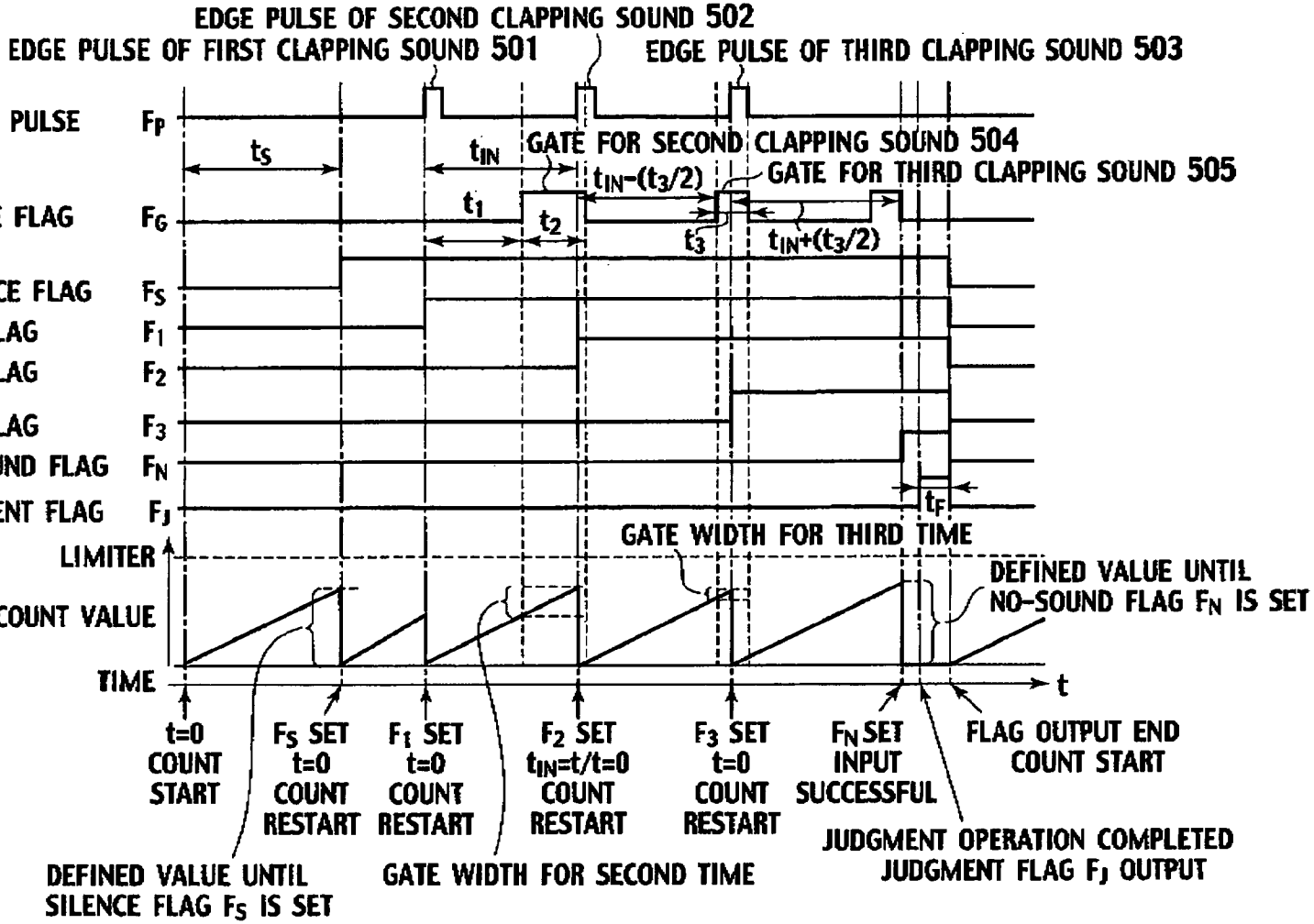
FIG. 6
(A) EDGE PULSE
(B) GATE FLAG
(C) SILENCE FLAG
(D) FLAG
(E) FLAG
(F) FLAG
(G) NO-SOUND FLAG
(H) JUDGMENT FLAG
(I) COUNT VALUE
EDGE PULSE OF FIRST CLAPPING SOUND 501
EDGE PULSE OF SECOND CLAPPING SOUND 502
EDGE PULSE OF THIRD CLAPPING SOUND 503
GATE FOR SECOND CLAPPING SOUND 504
GATE FOR THIRD CLAPPING SOUND 505
$F_P$
$F_G$
$F_S$
$F_1$
$F_2$
$F_3$
$F_N$
$F_J$
$t_S$
$t_{IN}$
$t_1$
$t_2$
$t_3$
$t_{IN}-(t_3/2)$
$t_{IN}+(t_3/2)$
$t_F$
LIMITER
GATE WIDTH FOR THIRD TIME
DEFINED VALUE UNTIL NO-SOUND FLAG $F_N$ IS SET
TIME
t
t=0 COUNT START
$F_S$ SET t=0 COUNT RESTART
$F_1$ SET t=0 COUNT RESTART
$F_2$ SET $t_{IN}=t/t=0$ COUNT RESTART
$F_3$ SET t=0 COUNT RESTART
$F_N$ SET INPUT SUCCESSFUL
FLAG OUTPUT END COUNT START
JUDGMENT OPERATION COMPLETED JUDGMENT FLAG $F_J$ OUTPUT
GATE WIDTH FOR SECOND TIME
DEFINED VALUE UNTIL SILENCE FLAG $F_S$ IS SET

FIG. 12

| | FIRST CLAP | SECOND CLAP | THIRD CLAP |
|---|---|---|---|
| HIGH-PASS EDGE DETECTION FLAG $F_{PH}$ | ○ | × | ○ |
| LOW-PASS EDGE DETECTION FLAG $F_{PL}$ | ○ | ○ | ○ |
| CALCULATION CONTENT | LOGICAL PRODUCT | LOGICAL SUM | LOGICAL SUM |
| CALCULATION RESULT | ○ | ○ | ○ |
| FIRST EVALUATION | THERE IS CALCULATION RESULT | THERE IS CALCULATION RESULT | THERE IS CALCULATION RESULT |
| SECOND EVALUATION | | THREE OR MORE DETECTION TIMES IN TOTAL | |

| | PERIOD (T1) | PERIOD (T2) | PERIOD (T3) |
|---|---|---|---|
| CONDITIONS FOR JUDGMENT OF THREE TIMES | × | × | - |
| CONDITIONS FOR JUDGMENT OF FOUR TIMES | × | ○ | × |

ELECTRONIC APPLIANCE AND VOICE SIGNAL PROCESSING METHOD FOR USE IN THE SAME

BACKGROUND OF THE INVENTION

1. Field of the Invention

The present invention relates to an electronic appliance and a voice signal processing method for use in the electronic appliance. More particularly, it relates to an electronic appliance which processes a voice signal output from an electronic appliance main body and a voice signal to be input into the electronic appliance, and a voice signal processing method for use in this electronic appliance.

2. Description of the Related Art

Electronic appliances such as television receiver, audio system and air conditioner presently used are usually controlled by touching an operation button of a main body or by using a remote controller (hereinafter referred to as the RC). In the former case, an operator has to come close to the main body of the electronic appliance as a control target. When the electronic appliance is distant from the operator, the control is very laborious. This problem is solved using the RC as in the latter case.

Once the RC is taken by hand, the apparatus can be controlled without moving. However, if the RC is not near to the operator, the operator has to find out a place where the RC is present and fetch the RC. However, in a case where the apparatus is not continuously controlled and it is desired to readily control any one operation, for example, in a case where a power supply only is turned on first of all, the operator feels troublesome. Furthermore, there often occurs a situation in which the use of the RC is desired but the RC is not found.

In Japanese Patent Application Laid-Open Nos. 03-54989 and 03-184497, a method is disclosed in which the electronic appliance is controlled with a clapping sound instead of the RC.

In a case where the electronic appliance is controlled with the clapping sound, there is a problem that the clapping sound is deafened with a sound output from the electronic appliance main body or a sound generated around the electronic appliance, and thus the electronic appliance cannot be controlled as desired. There is also a problem that the sound output from the electronic appliance main body is detected as the clapping sound, and thus an erroneous operation occurs.

In addition, in a case where the electronic appliance (e.g., a television receiver (hereinafter referred to as the television)) is controlled with the clapping sound, when a power supply of a television 1201 is tuned off as shown in (A) of FIG. 17, the control can normally be performed. On the other hand, when the power supply of the television 1201 is turned on as shown in (B) of FIG. 17, not only the clapping sound but also a voice (hereinafter referred to as a main body sound) of a program being watched or contents that are simultaneously output from a speaker 1202 are detected by a microphone 101. Therefore, the clapping sound is buried in the main body sound, and thus the control might be obstructed.

Moreover, the erroneous operation might be caused by the main body sound. For example, when clapping occurs in the program being watched, the clapping with a certain sound level or more is detected as a clapping sound, and the clapping might continue as much as the predetermined number of times to cause the erroneous operation.

To cope with this problem, when the power supply of the electronic appliance is turned on, the control with the clapping sound may be prohibited. In this case, an operation which can be performed with the clapping sound is limited to the control at a time when the power supply is turned off, for example, an operation of turning on the power supply. A range of application is reduced, and a large restriction is imposed on this function.

SUMMARY OF THE INVENTION

The present invention has been developed in view of the above respect, and an object thereof is to provide an electronic appliance and a voice signal processing method for the electronic appliance in which a clapping sound buried in a sound from an electronic appliance main body or a surrounding noise can be detected during control of the electronic appliance with the clapping sound or the like and accordingly erroneous operations are reduced.

To achieve the above object, the present invention provides the following (a) to (f).

(a) An electronic appliance comprising: a speaker (122) which subjects a first voice signal generated from the electronic appliance to electricity-sound conversion to output the converted first voice signal; a sound detector (101) which detects a second sound wave where a sound wave generated for control of the electronic appliance is superimposed on a first sound wave based on the first voice signal emitted from the speaker and which subjects the second sound wave to sound-electricity conversion to output a second voice signal; a first waveform generator (125, 126) which subjects the first voice signal to predetermined signal processing to generate a first waveform signal; a second waveform generator (105, 106) which subjects the second voice signal output from the sound detector to predetermined signal processing to generate a second waveform signal; a waveform shaping unit (128) which enlarges the first waveform signal in a time axis direction to output a third waveform signal; and a subtracter (130) which subtracts the third waveform signal from the second waveform signal.

(b) The electronic appliance according to (a), wherein the first waveform generator includes a first offset component removal section (125) to generate a voice signal in which an offset component is removed from the first voice signal, and a first absolute value forming circuit (126) which forms an absolute value of the voice signal output from the first offset component removal section to output the first waveform signal, and the second waveform generator includes a second offset component removal section (105) to generate a voice signal in which an offset component is removed from the second voice signal, and a second absolute value forming circuit (106) which forms an absolute value of the voice signal output from the second offset component removal section to output the second waveform signal.

(c) The electronic appliance according to (a), wherein the waveform shaping unit includes a plurality of retaining units ($\mathbf{152}_1$ to $\mathbf{152}_N$) which retain the first waveform signals for a predetermined time, and an extractor (153) which extracts maximum values of the plurality of first waveform signals output from the plurality of retaining units and which synthesizes the plurality of extracted maximum values in time series to generate the third waveform signal.

(d) A voice signal processing method comprising: an electricity-sound conversion step of subjecting a first voice signal generated from an electronic appliance to electricity-sound conversion to output the first voice signal; a sound detecting step of detecting a second sound wave in which a sound wave generated for control of the electronic appliance is superimposed on a first sound wave based on the first voice signal; a sound-electricity conversion step of subjecting the second sound wave to sound-electricity conversion to output a second voice signal; a first waveform generation step of subjecting the first voice signal to predetermined signal processing to generate a first waveform signal; a second waveform generation step of subjecting the second voice signal to predetermined signal processing to generate a second waveform signal; a waveform shaping step of enlarging the first waveform signal in a time axis direction to output a third waveform signal; and a subtraction step of subtracting the third waveform signal from the second waveform signal.

(e) The voice signal processing method according to (d), wherein the first waveform generation step includes a first offset component removal step of generating a voice signal in which an offset component is removed from the first voice signal, and a first absolute value forming step of forming an absolute value of the voice signal output in the first offset component removal step to output the first waveform signal, and the second waveform generation step includes a second offset component removal step of generating a voice signal in which an offset component is removed from the second voice signal, and a second absolute value forming step of forming an absolute value of the voice signal output in the second offset component removal step to output the second waveform signal.

(f) The voice signal processing method according to (d), further comprising: a retaining step of retaining the plurality of first waveform signals for a predetermined time, respectively; and an extraction step of extracting maximum values of the plurality of first waveform signals and synthesizing the plurality of extracted maximum values in time series to generate the third waveform signal.

According to the present invention, since a sound generated from an electronic appliance main body, a surrounding noise and the like are removed, a clapping sound can be detected from an input voice signal.

The nature, principle and utility of the invention will become more apparent from the following detailed description when read in conjunction with the accompanying drawings.

BRIEF DESCRIPTION OF THE DRAWINGS

In the accompanying drawings:

FIG. 6 is a timing chart explaining a control method according to the first embodiment of the present invention;

FIG. 12 is a diagram showing evaluations in a case where clapping is performed three times to determine recognition by a judgment processing section 172 shown in FIG. 10:

DESCRIPTION OF THE PREFERRED EMBODIMENTS

First Embodiment

Figure 1:
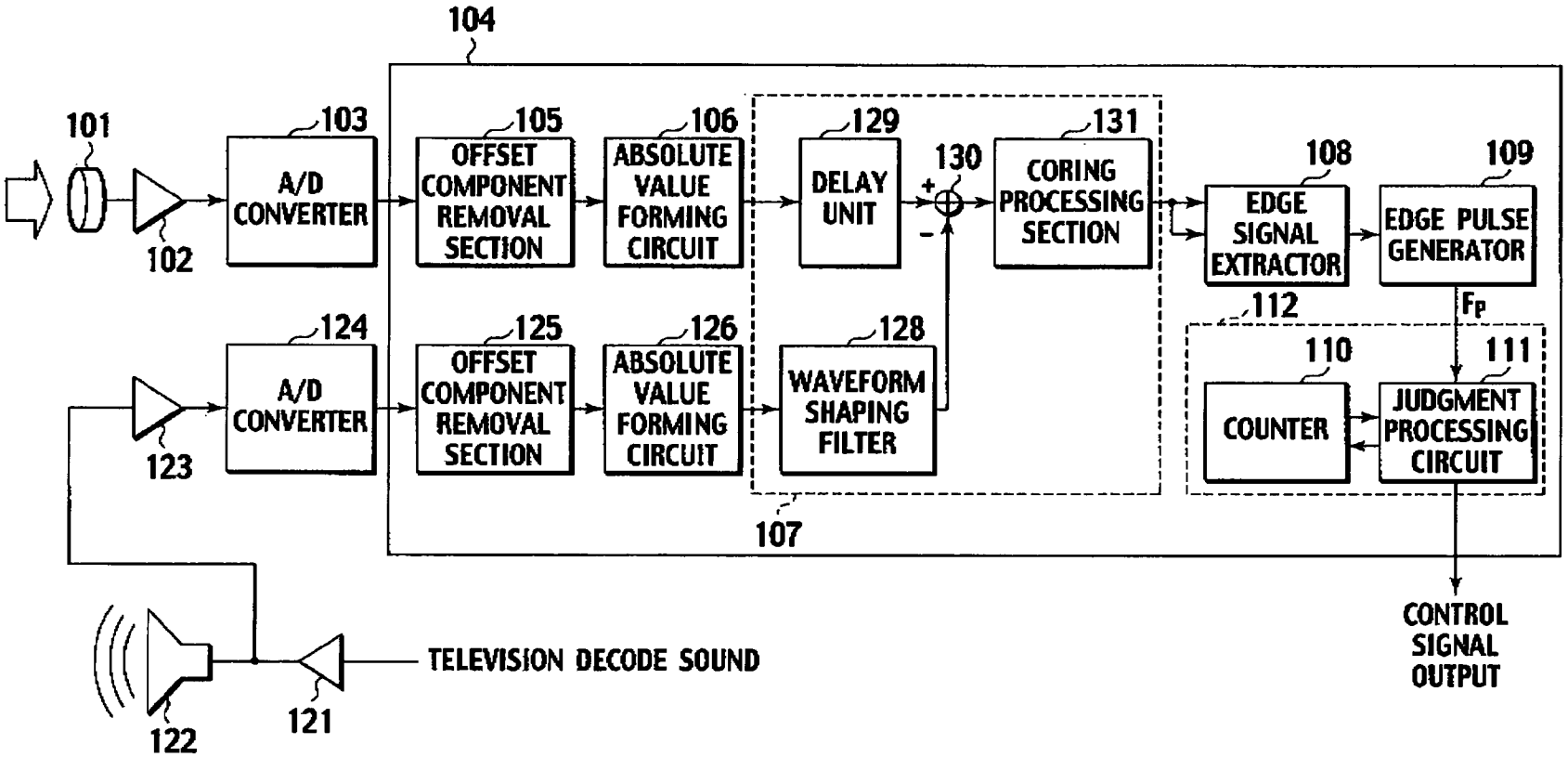
FIG. 1 is a block diagram of an electronic appliance according to a first embodiment of the present invention.

FIG. 1 is a block diagram showing a first embodiment of an electronic appliance according to the present invention. The electronic appliance of the first embodiment is, for example, television, and is controlled with a series of sound waves (e.g., a clapping sound) generated by an operator at predetermined time intervals.

In FIG. 1, the electronic appliance includes a microphone (hereinafter abbreviated as the MC) 101 which detects operator's clapping sound, an amplifier 102 which amplifies an analog voice signal from the MC 101, an A/D converter 103 which converts the analog voice signal output from the amplifier 102 into a digital voice signal, and a central processing unit (CPU) 104 which processes the digital voice signal output from the A/D converter 103 by software processing to detect the clapping sound, and then performs predetermined judgment processing peculiar to the present embodiment to generate and output a control signal.

Furthermore, the electronic appliance includes a main body amplifier 121 which amplifies a voice signal (a television decode sound) from a known voice detection circuit disposed in the electronic appliance, a main body speaker 122, an amplifier 123 which amplifies the voice signal from the main body amplifier 121, and an A/D converter 124 which converts an analog voice signal output from the amplifier 123 into a digital voice signal.

The MC 101 is a sound detector which detects a sound wave generated outside the electronic appliance. The MC 101 subjects the detected sound wave to sound-electricity conversion to output the analog voice signal. After the analog voice signal is amplified by the amplifier 102 to an optimum amplitude level with respect to a dynamic range of A/D conversion to be performed by the A/D converter 103 at a subsequent stage, the signal is supplied to the A/D converter 103. The A/D converter 103 converts the analog voice signal into the digital voice signal to supply the signal to the CPU 104.

The main body amplifier 121 amplifies the television decode sound generated from the electronic appliance to supply the sound to the main body speaker 122 and the amplifier 123. The main body speaker 122 subjects the supplied voice signal to electricity-sound conversion to output the sound from the electronic appliance. The amplifier 123 amplifies the supplied voice signal to supply the signal to the A/D converter 124. The A/D converter 124 converts the analog voice signal into the digital voice signal to supply the signal to the CPU 104.

The CPU 104 generates and outputs a control signal to control the electronic appliance based on the supplied digital voice signal. The CPU 104 includes an offset component removal section 105 and an absolute value forming circuit 106 which process the voice signal based on the sound wave detected by the MC 101, and an offset component removal section 125 and an absolute value forming circuit 126 which process the voice signal generated from the electronic appliance. Furthermore, the CPU 104 includes a main body sound removal circuit 107, an edge signal extractor 108, an edge pulse generator 109 and a judgment processing section 112 which process the voice signals output from the absolute value forming circuits 106, 126.

The offset component removal section 105 generates a voice signal in which an offset component is removed from the digital voice signal supplied from the A/D converter 103. The offset component will be described later. The absolute value forming circuit 106 forms an absolute value of the voice signal output from the offset component removal section 105. The offset component removal section 105 and the absolute value forming circuit 106 are waveform generators which process the voice signal output from the MC 101 to generate a waveform signal.

The offset component removal section 125 generates a voice signal in which the offset component is removed from the digital voice signal supplied from the A/D converter 124. The absolute value forming circuit 126 forms an absolute value of the voice signal output from the offset component removal section 125. The offset component removal section 125 and the absolute value forming circuit 126 are waveform generators which process the voice signal output from an electronic appliance main body to generate a waveform signal.

The offset component removal sections 105, 125 are constituted in the same manner, respectively. For example, the voice signal is generated in which, for example, a high-frequency component of the input digital voice signal is decayed with a low pass filter (LPF), and the voice signal having the high-frequency component decayed is subtracted from the input digital voice signal by a subtracter to remove the offset component of the digital voice signal. A time constant of the LPF is increased to delay tracking, and an approximate average value of the input digital voice signals can be obtained to stabilize a level at a time when any signal is not emitted. The level at the no-signal time is a zero level which is a reference level in a case where the absolute value is formed at the subsequent stage.

The main body sound removal circuit 107 generates a voice signal from which the voice signal generated from the electronic appliance main body has been removed, based on the voice signals supplied from the absolute value forming circuits 106, 126. The main body sound removal circuit 107 includes a waveform shaping filter 128, a delay unit 129, a subtracter 130 and a coring processing section 131 as described later.

The edge signal extractor 108 generates an edge signal based on the voice signal output from the main body sound removal circuit 107, and the edge pulse generator 109 generates an edge pulse based on the edge signal. It is to be noted that the edge signal extractor 108 has two inputs for reasons described later.

The judgment processing section 112 includes a counter 110 and a judgment processing circuit 111. The judgment processing section 111 generates various flags based on the edge pulse and a counter value from the counter 110, and outputs a control signal.

It is to be noted that, in this embodiment, the digital voice signals output from the A/D converters 103, 124 are processed by software of the CPU 104. However, the processing may partially or entirely be constituted of hardware. When the processing is constituted of the hardware, the electronic appliance can easily be controlled as desired even at a time when the apparatus is on standby.

Figure 2:
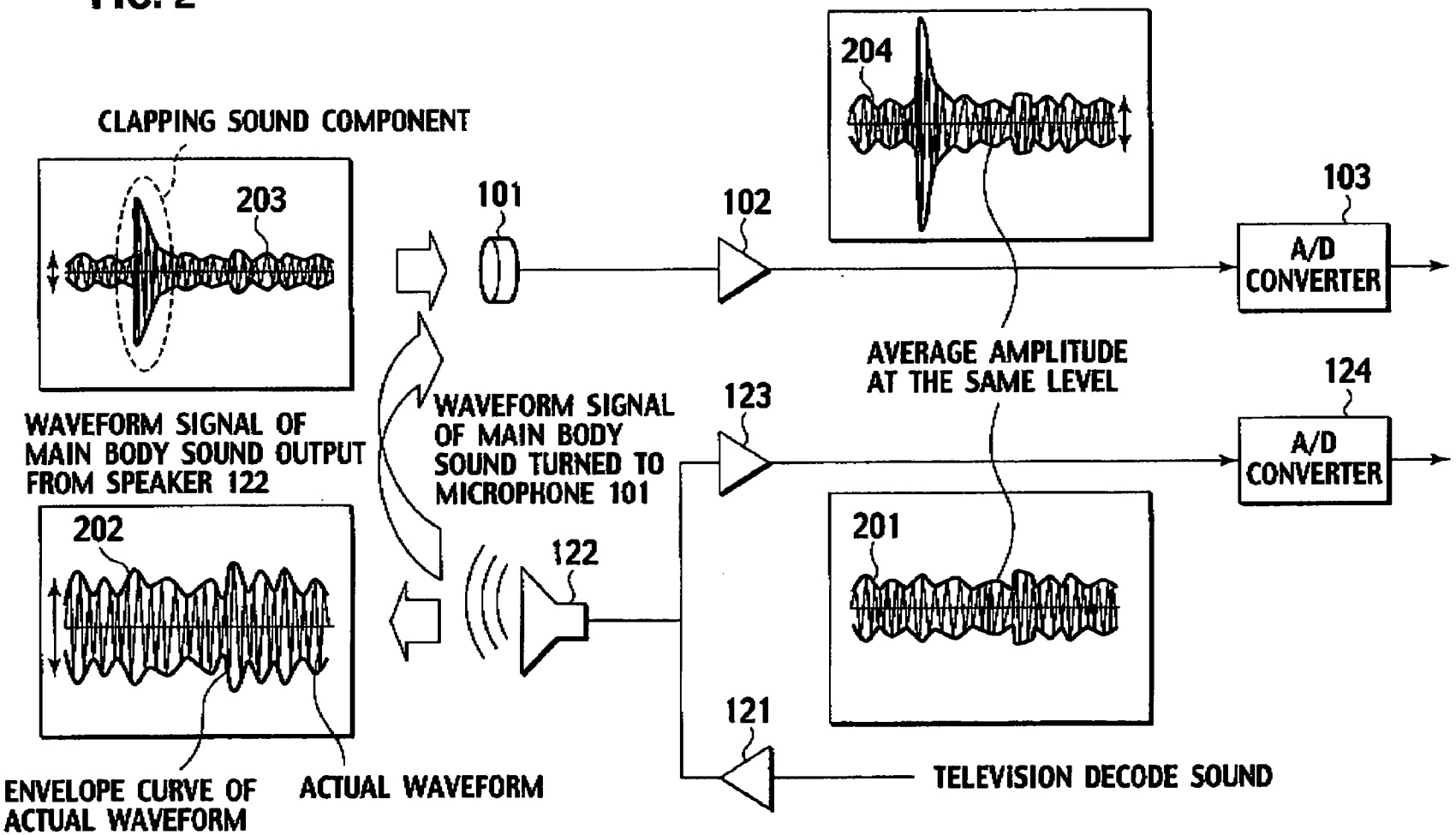
FIG. 2 is a diagram showing waveform signals of a sound output from a main body speaker 122 and a sound input into a microphone 101 before and after amplified with an amplifier.

Next, the first embodiment shown in FIG. 1 will be described in order of the processing in detail. FIG. 2 is a diagram showing a waveform signal of the sound wave detected by the MC 101, a waveform signal of the voice signal amplified by the amplifier 102, a waveform signal of the sound wave emitted from the main body speaker 122 based on the voice signal (the television decode sound) generated from the electronic appliance, and a waveform signal of the voice signal amplified by the amplifier 123.

Though an actual waveform signal includes various frequency components and amplitudes as shown in waveform signals 201 to 204, envelope curves of the waveform signals are subsequently shown to simplify the drawing. However, the actual waveform signals are processed.

In FIG. 2, the television decode sound is amplified by the main body amplifier 121 to such a suitable level that the sound is output from the main body speaker 122, and subjected to the electricity-sound conversion by the main body speaker 122 to output the waveform signal 202. The voice signal amplified by the main body amplifier 121 is further amplified by the amplifier 123, and supplied as the waveform signal 201 to the A/D converter 124. The television decode sound of the waveform signal 201 is used in the main body sound removal circuit 107 as described later.

The waveform signal 203 is obtained by superimposing the sound wave of the clapping sound generated for control of the electronic appliance on the sound wave based on the voice signal (the waveform signal 202) emitted from the main body speaker 122. The voice signal based on the sound wave of the waveform signal 203 is amplified by the amplifier 102, and accordingly the waveform signal 204 is obtained.

Here, an amplitude level of the waveform signal 202 is largely different from that of the waveform signal 203 in many oases. Therefore, the waveform signal 203 is regulated by the amplifier 102, and the waveform signal 202 is regulated by the amplifier 123 so that the signals reach levels suitable for the subsequent processing to be performed. It is to be noted that a gain is sometimes 1 or less.

The suitable level mentioned herein indicates that an average amplitude of the waveform signals based on main body sound components among the waveform signals 204 input into the A/D converter 103 has a level equal to that of the waveform signals 201 input into the A/D converter 124.

In the present embodiment, it is assumed that the gain of the amplifier 123 is fixed so as to set the waveform signal to the suitable level, but the gain may dynamically be changed and regulated in accordance with a difference between amplitude values of the waveform signal 203 and the waveform signal 202.

It is to be noted that the voice signal before amplified by the main body amplifier 121 may be supplied to the A/D converter 124 on conditions that the amplitude of the waveform signal output from the main body speaker 122 has a proportionality relation with respect to the amplitude of the waveform signal before amplified by the main body amplifier 121. That is, it is a condition that the waveform signal before amplified by the main body amplifier 121 is a voice signal after control of a volume. Also in this case, the signal needs to be amplified to the suitable level as described above.

The waveform signal 204 amplified to the suitable level by the amplifier 102 and the waveform signal 201 amplified to the suitable level by the amplifier 123 are converted from analog values into digital values by the A/D converters 103, 124, respectively. The waveform signal 204 converted into the digital value is processed by the offset component removal section 105 and the absolute value forming circuit 106 to form a waveform signal 301 described later. Similarly, the waveform signal 201 is processed by the offset component removal section 125 and the absolute value forming circuit 126 to form a waveform signal 302 described later.

Next, the main body sound removal circuit 107 and the edge signal extractor 108 shown in FIG. 1 will be described with reference to FIG. 3. It is to be noted that the subsequent processing is all performed every A/D conversion period $T_{AD}$.

Figure 3:
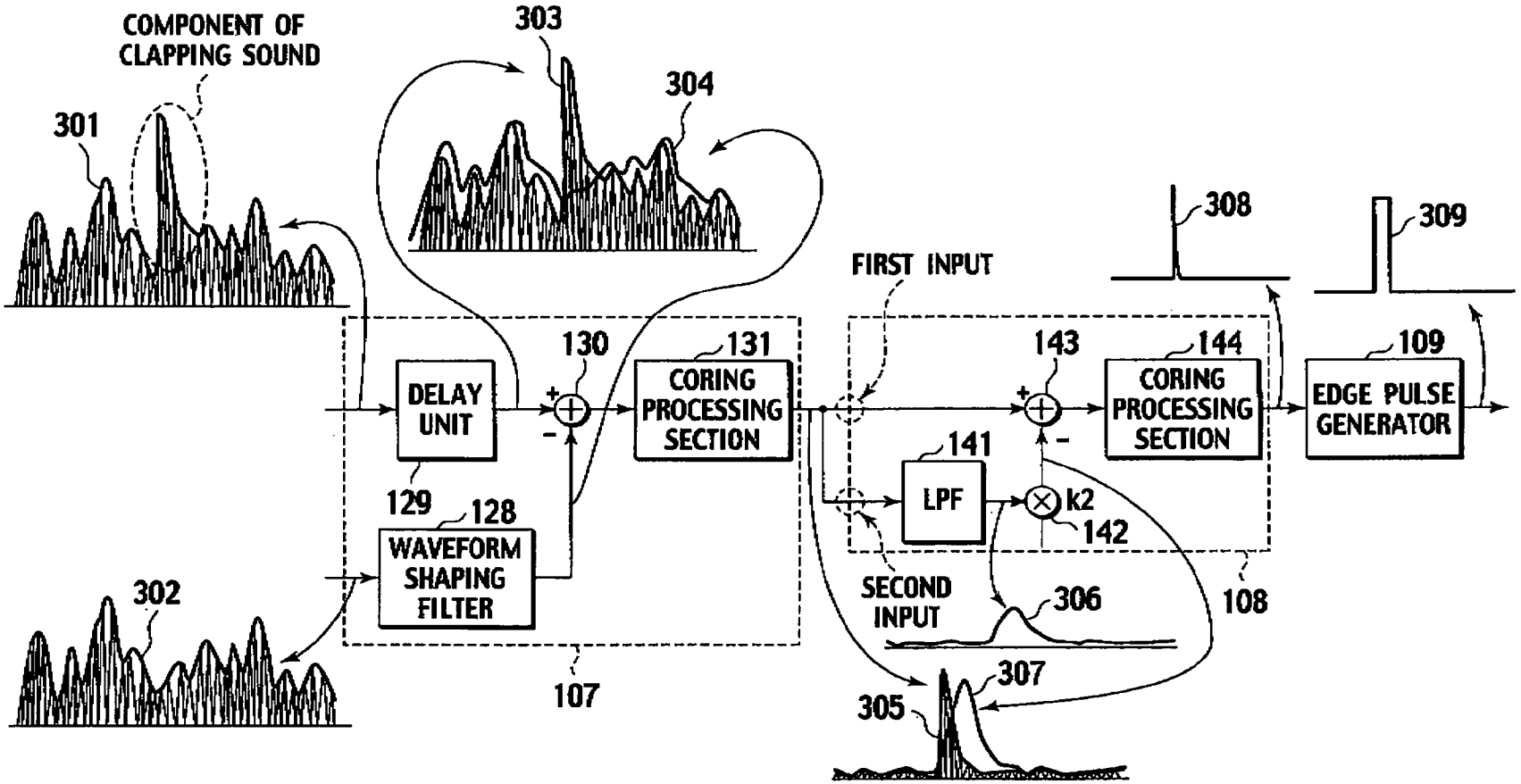
FIG. 3 is a diagram showing constitutions of a main body sound removal circuit 107 and an edge signal extractor 108 of FIG. 1 and examples of processing contents.

In FIG. 3, as described above, the main body sound removal circuit 107 includes the delay unit 129 which receives the waveform signal 301 supplied from the absolute value forming circuit 106, the waveform shaping filter 128 which receives the waveform signal 302 supplied from the absolute value forming circuit 126, the subtracter 130 and the coring processing section 131. As described above, the waveform signal 301 is based on the sound wave detected by the MC 101, and the waveform signal 302 is based on the sound wave emitted from the electronic appliance.

Here, it is assumed that, in the main body sound removal circuit 107, the waveform signal 302 is subtracted from the waveform signal 301 to remove, from the voice signal detected by the MC 101, the main body sound component which is the voice signal emitted from the electronic appliance. However, when the waveform signal 302 is simply subtracted from the waveform signal 301, it is difficult to sufficiently remove the main body sound component included in the waveform signal 301. This is because the main body sound component included in the waveform signal 301 is originally the same signal as the waveform signal 302, but has different component and amplitude owing to a transmission characteristic along a path from the main body speaker 122 to the MC 101.

To match the main body sound component included in the waveform signal 301 with the waveform signal 302, the above transmission characteristic needs to be obtained. The transmission characteristic is influenced by a positional relation between the main body speaker 122 and the MC 101 and a surrounding environment. To dynamically obtain the transmission characteristic, a large-scaled circuit and a large processing amount are required. Therefore, it is actually difficult to obtain the characteristic.

To solve the problem, in the present embodiment, the waveform signal 302 is shaped by the waveform shaping filter (a waveform shaping unit) 128 so that the main body sound component can sufficiently be removed from the waveform signal 301. The waveform shaping filter 128 enlarges the waveform signal 302 in a time axis direction as described later to output a waveform signal 304. Furthermore, the waveform shaping filter 128 is realized with a simple circuit.

Figure 4:
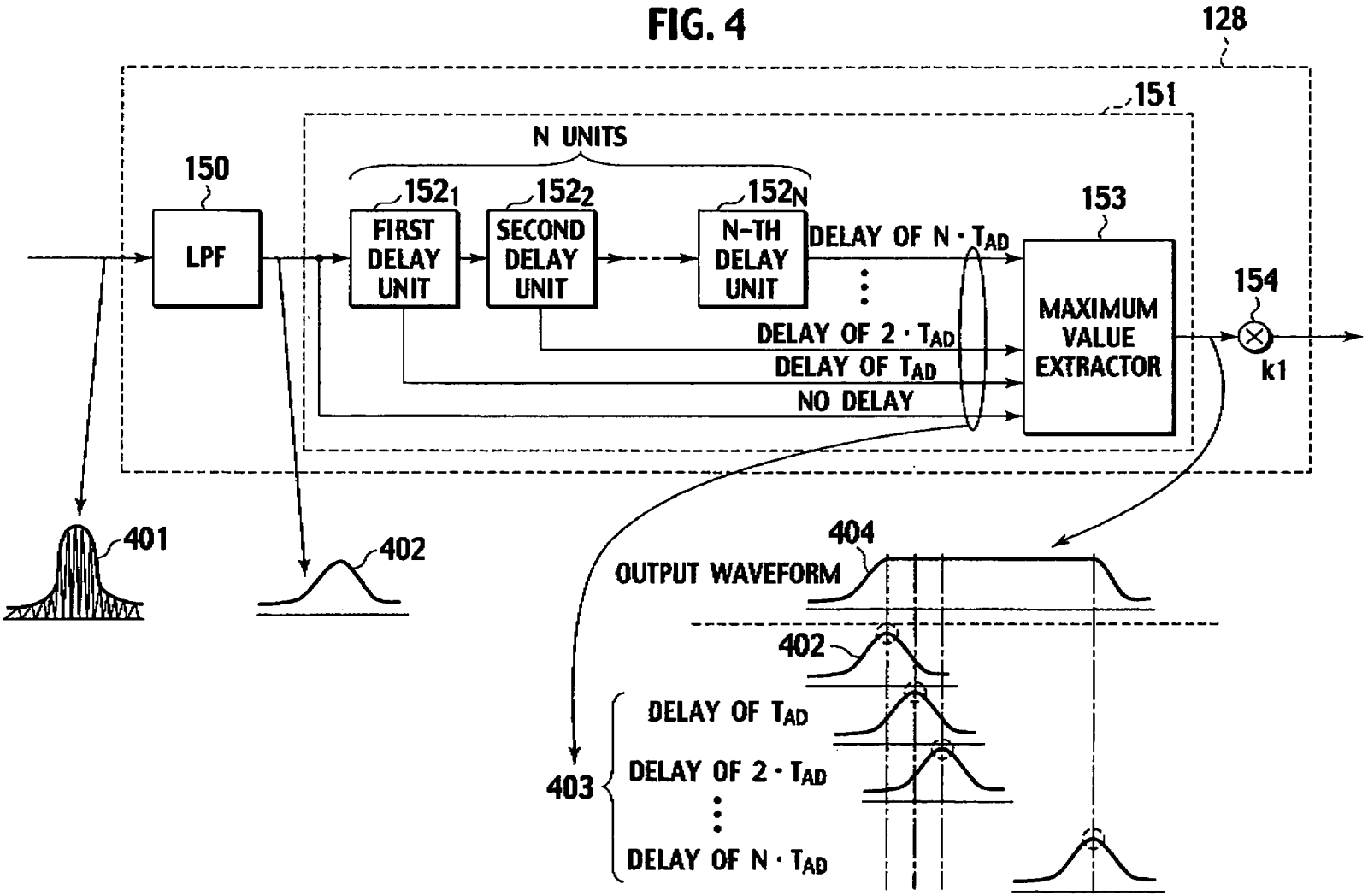
FIG. 4 is a diagram showing a constitution of a waveform shaping filter 128 of FIG. 1 and examples of processing contents.

FIG. 4 is a diagram showing a constitution of the waveform shaping filter 128 of FIGS. 1 and 3 and examples of processing contents. The waveform shaping filter 128 includes a low pass filter (LPF) 150 which selects a frequency of a low-pass frequency component of an input signal, a wide-range processing section 151 which subjects an output signal of the LPF 150 to predetermined processing described later, and a multiplier 154 which multiplies a signal output from the wide-range processing section 151 by a predetermined multiplication coefficient k1.

In FIG. 4, the wide-range processing section 151 includes N delay units $\mathbf{152}_1$ to $\mathbf{152}_N$ connected to one another in tandem and having a delay time $T_{AD}$, respectively, and a maximum value extractor 153 which extracts maximum values from output signals from the delay units $\mathbf{152}_1$ to $\mathbf{152}_N$ and an output from the LPF 150. The wide-range processing section 151 constitutes a peak holding circuit which holds a peak value of an input signal for a time $N \cdot T_{AD}$.

A case where a waveform signal 401 shown in FIG. 4 is input into the waveform shaping filter 128 constituted in this manner will be described. First, the waveform signal 401 input into the waveform shaping filter 128 is processed by the LPF 150. Since the LPF 150 selects the low-pass frequency component of the input signal in accordance with the frequency, a component having a comparatively high frequency is removed from components forming the waveform signal 401 and only components having low frequencies remain. Therefore, a signal such as a waveform signal 402 which tracks the envelope curve of the waveform signal 401 with delay is output from the LPF 150.

Next, the wide-range processing section 151 performs processing to enlarge the waveform signal 402 in the time axis direction. In the present embodiment, the waveform signal 402 input into the wide-range processing section 151 is successively delayed as much as the time $T_{AD}$ by the N delay units $\mathbf{152}_1$ to $\mathbf{152}_N$, and the maximum value extractor 153 extracts the maximum values from the waveform signal 402 and N waveform signals 403 obtained by delaying the waveform signal 402. The delay units $\mathbf{152}_1$ to $\mathbf{152}_N$ are holding units which hold the input signals as much as the delay time $T_{AD}$. The maximum value extractor 153 synthesizes the extracted maximum values in time series to generate and output a waveform signal 404. The waveform signal 404 is broader than the waveform signal 402 in the time axis direction.

Finally, the waveform signal 404 is multiplied by k1 by the multiplier 154, and output as an output waveform signal of the waveform shaping filter 128. The output waveform signal of the multiplier 154 corresponds to the output waveform signal 304 of FIG. 3.

The embodiment will be described with reference to FIG. 3 again. An appropriate delay is added to the waveform signal 301 by the delay unit 129 as much as a delay generated by transmitting the waveform signal 302 through the waveform shaping filter 128 to form a waveform signal 303. The waveform signal 301 is the same as the waveform signal 303. The subtracter 130 subtracts, from the waveform signal 303, the waveform signal 304 output from the waveform shaping filter 128. In consequence, the subtracter 130 can output a waveform signal in which the main body sound component is removed from the waveform signal 303 based on the sound wave detected by the MC 101.

When the wide-range processing section 151 of FIG. 4 enlarges portions of the waveform signal 302 having large amplitudes in the time axis direction, even a pulsed component having a comparatively large amplitude can sufficiently be removed except the clapping sound included in the waveform signal 301. The constant value k1 of the multiplier 154 is set so that the amplitude of the waveform signal 304 is larger than that of the main body sound component of the waveform signal 303. In consequence, all the main body sound components can nearly be removed. However, when the amplitude of the waveform signal 304 is set to be excessively large, the clapping sound components of the waveform signal 303 do not remain, and the clapping sound cannot be detected. Therefore, an appropriate value needs to be selected so as to satisfy these conditions.

The waveform signal output from the subtracter 130 is subjected to coring processing to set, to "0", a value which is smaller than a certain threshold value by the coring processing section 131. In consequence, a waveform is generated from which remaining fine noises have been removed and in which an only clapping sound component such as a waveform signal 305 is left.

Subsequently, the edge signal extractor 108 performs processing to extract the only edge signal from the waveform signal 305. The edge signal extractor 108 has two inputs of a first input and a second input. In the present embodiment, the waveform signal 305 output from the main body sound removal circuit 107 forms the first input and the second input.

The edge signal extractor 108 includes an LPF 141, a multiplier 142, a subtracter 143 and a coring processing section 144. The first input is input into the subtracter 143, and the second input is input into the LPF 141. The LPF 141 generates a waveform signal 306 in which a high-frequency component of the waveform signal 305 is decayed. The LPF 141 has a purpose of obtaining appropriate delay and waveform. The multiplier 142 multiplies the waveform signal 306 by a constant value k2 to generate a waveform signal 307. The subtracter 143 subtracts the waveform signal 307 from the waveform signal 305.

As a result of subtraction by the subtracter 143, a rising portion of the waveform signal 305 having a high frequency remains as it is, but the waveform signal 307 sufficiently tracks a sound having a comparatively low frequency, for example, a speaking voice, a surrounding noise and the like included in the waveform signal 305. Therefore, another portion falls to be negative.

The coring processing section 144 subjects a waveform signal output from the subtracter 143 to coring processing to set an output value to "0" in a case where an input value is smaller than a certain threshold value, and generates a waveform signal such as a waveform signal 308 having an only steep edge. The threshold value of the coring processing section 144 is set to an appropriate positive value, not "0". In consequence, even a remaining small noise can be removed.

The edge pulse generator 109 generates an edge pulse based on the waveform signal 308 (the edge signal) output from the edge signal extractor 108. Here, the edge signal can simply be level-sliced to generate the edge pulse. However, to improve a resistance to the noise and sensitivity to the edge signal, in the present embodiment, a method shown in FIG. 5 is used.

Figure 5:
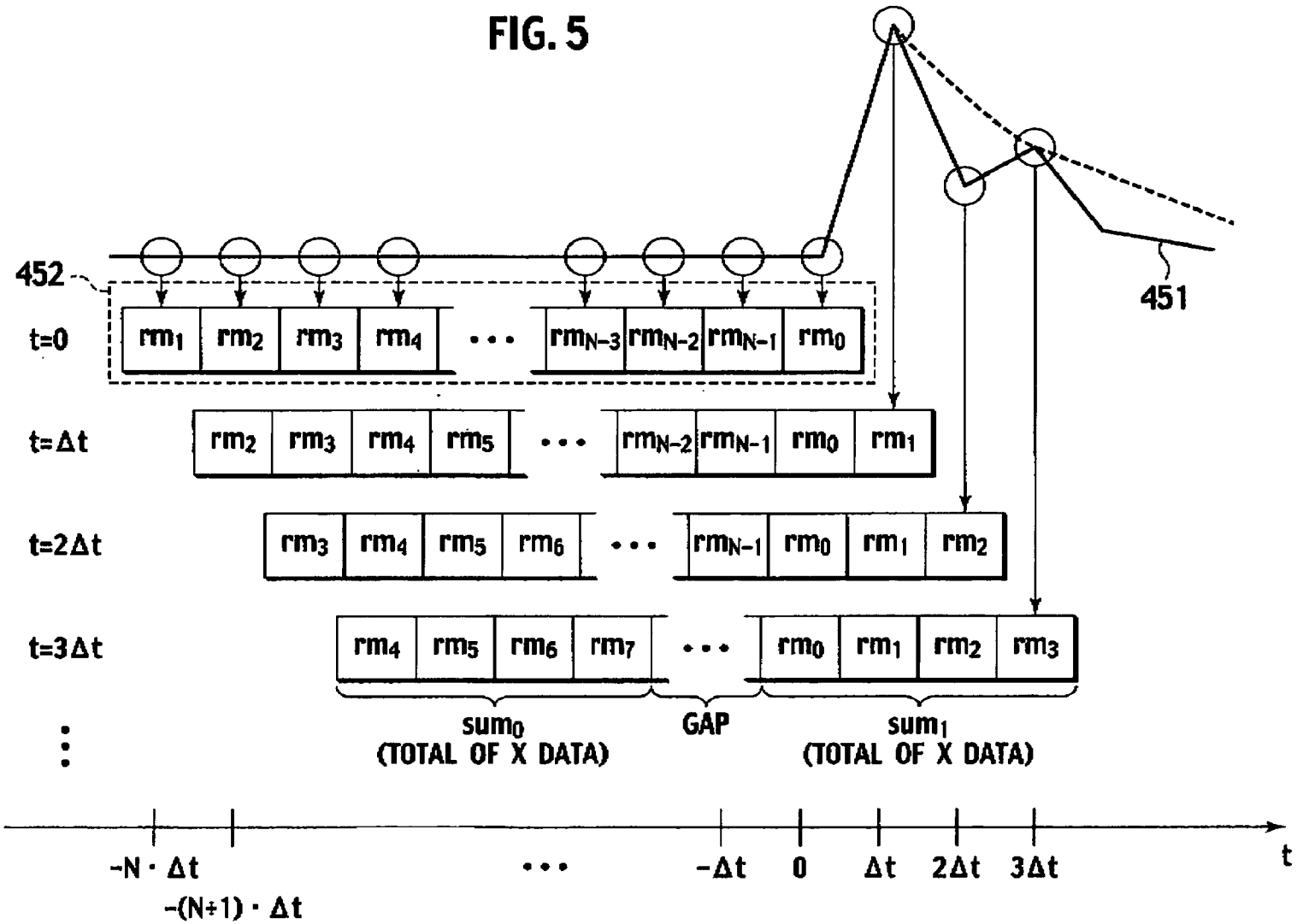
FIG. 5 is a diagram showing processing contents of an edge pulse generator 109 of FIG. 1.

A waveform signal 451 shown in FIG. 5 is shown by enlarging the waveform signal 308 of FIG. 3, and circle marks indicate sampling data. The edge pulse generator 109 includes a ring memory 452 including N memories ($rm_0$ to $rm_{N-1}$) which retain the sampling data.

Assuming that the present time is t=0, the sampling data of $t=-N\cdot\Delta t$ of the waveform signal 451 is stored in a memory $rm_1$, and a value of $t=(-N+1)\cdot\Delta t$ is stored in a memory $rm_2$. Similarly, sampling data of $t=(-N+2)\cdot\Delta t, \ldots, t=0$ of the waveform signal 451 are stored in memories $rm_3, \ldots, rm_0$ in order. In the ring memory 452, the sampling data of the past N times from the present time t=0 are stored. It is to be noted that Δt is a period of the A/D conversion to be performed by the A/D converters 103, 124.

Subsequently, at a time t=Δt, the sampling data of t=Δt of the waveform signal 451 is overwritten and updated in the memory $rm_1$. That is, the sampling data of the present time is stored in the memory in which the oldest sampling data (here, $t=-N\cdot\Delta t$) is stored at the present time t=Δt. The memories $rm_2$ to $rm_0$ retain a value equal to that stored at t=0. Similarly, the memories are successively updated one by one at each Δt, and the values of the past N times from the present time can be referred.

The edge pulse generator 109 judges that the edge signal has been input, when the following is satisfied:

$$sum_1 - sum_0 > y_{th},$$

in which, among N sampling data stored in such a ring memory 452, $sum_0$ is a sum obtained by weighted-averaging of x data (x is smaller than N) in order from the oldest stored data, and $sum_1$ is a sum obtained by weighted-averaging of x data in order from the latest stored data including the present value. The edge pulse generator outputs the edge pulse having a predetermined pulse width as shown by a waveform signal 309 of FIG. 3. In the present embodiment, a coefficient is set to ¼ to obtain a weighted average value. It is to be noted that x is set so as to obtain a time interval (a gap) between a time when the x sampling data are recorded in order from the oldest data and a time when the x sampling data are recorded in order from the newest data including the value of the present time. That is, x is set to such a value as to satisfy a relation x+x<N.

In the present embodiment, the gap is provided as described above, but x may be set so that the time when the x sampling data are recorded in order from the oldest data is adjacent to the time when the x sampling data are recorded in order from the newest data including the value of the present time. At this time, a relation x+x=N is satisfied.

Here, the waveform signal 308 obtained by the coring processing in the coring processing section 144 does not have only one large edge, and, in actual, a waveform is undulated as shown by the waveform signal 451 shown in FIG. 5. Therefore, the edge pulse generator 109 outputs the edge pulse having the predetermined pulse width to provide a dead zone, and it is avoided that single one clap is detected many times.

Moreover, $y_{th}$ described above is a threshold value of edge detection. As the threshold value decreases, the clapping sound is easily detected, but erroneous detection due to the surrounding noise or the like increases. On the other hand, as $y_{th}$ increases, the erroneous detection is reduced, but the clapping sound is not easily detected. To solve the problem, $y_{th}$ is set so that the clapping sound can correctly be detected, and the erroneous detection can be reduced as much as possible.

As in this embodiment, the edge pulse generator 109 obtains a difference from $sum_0$, $sum_1$ each obtained by the weighted-averaging of x values, instead of one amplitude value of the waveform. Therefore, a difference value of the edge signal even having a blunt waveform preferably increases. The value has a high resistance to ringing and the noise, and edge detection processing can satisfactorily be performed.

Next, the judgment processing section 112 shown in FIG. 1 will be described in detail. As described above, the judgment processing section 112 performs judgment processing peculiar to the present embodiment based on the edge pulse output from the edge pulse generator 109 and the count value from the counter 110.

FIG. 6 is a timing chart showing a control method (a judgment processing algorithm) of the judgment processing section 112. FIG. 6 shows a case where three sound waves (the clapping sounds) are generated for the control of the electronic appliance. An outline will hereinafter be described.

In FIG. 6, assuming that a period when the clapping sound or a noise similar to the clapping sound to be generated for the control of the electronic appliance is not generated is $t_s$, the judgment processing circuit 111 generates a silence flag $F_S$ shown as (C) in FIG. 6. After the silence flag $F_S$ is generated, the MC 101 detects the clapping sound which is a first sound wave generated by a user. This first sound wave is first generated in the series of sound waves to be generated for the user to control the electronic appliance at the predetermined time intervals. The edge pulse generator 109 generates a first edge pulse 501 corresponding to the first sound wave shown as (A) in FIG. 6. After elapse of a first predetermined time $t_1$ from a first time when the edge pulse generator 109 generated the first edge pulse 501, the judgment processing circuit 111 generates a gate 504 for the second clapping sound having a time width $t_2$ shown as (B) in FIG. 6 to detect whether or not a second sound wave of the series of the sound waves has been generated.

Subsequently, the user generates the second sound wave of the series of sound waves in the gate 504. The edge pulse generator 109 generates a second edge pulse 502 corresponding to the second sound wave shown as (A) in FIG. 6. After elapse of a second predetermined time $t_{IN}-(t_3/2)$ from a second time when the edge pulse generator 109 generated the second edge pulse 502, the judgment processing circuit 111 generates a gate 505 for the third clapping sound having a time width $t_3$ shown as (B) in FIG. 6 to detect whether or not a third sound wave of the series of the sound waves has been generated.

Subsequently, the user generates the third sound wave of the series of sound waves in the gate 505. The edge pulse generator 109 generates a third edge pulse 503 corresponding to the third sound wave shown as (A) in FIG. 6. After elapse of a third predetermined time $t_{IN}+(t_3/2)$ from a third time when the edge pulse generator 109 generated the third edge pulse 503, the judgment processing circuit 111 generates a no-sound flag $F_N$ indicating that input of the sound wave into the MC 101 has stopped. Moreover, the judgment processing circuit 111 generates the no-sound flag $F_N$ to determine that the input of the sound wave into the MC 101 has stopped.

Next, a judgment operation of the judgment processing section 112 will be described in order. In the present embodiment, a constitution example in which the silence flag $F_S$, flags $F_1$ to $F_3$ and a no-sound flag $F_N$ are all set in FIG. 6 is regarded as a preferable control method.

First, the judgment processing circuit 111 of the judgment processing section 112 judges whether or not the silence flag $F_S$ shown in FIG. 6(C) has been set. From a state in which the silence flag $F_S$ is not set and an edge pulse $F_P$ shown as (A) in FIG. 6 is "0", the counter 110 starts counting. The count value increases from a count start time (t=0) as shown in (I) of FIG. 6. For the certain period $t_s$ until the count value reaches a defined value, the judgment processing circuit 111 judges whether or not a state in which the edge pulse $F_P$ is not set (a state of logic 0) continues as shown in (A) of FIG. 6.

In a case where the state in which the edge pulse $F_P$ is not set continues for the certain period $t_s$, the judgment processing circuit 111 regards the state as silence to set the silence flag $F_S$ as shown in (C) of FIG. 6 (logic 1 results). In consequence, the time t of the counter 110 is reset to "0", and a series of judgment operations start.

In a case where the certain period $t_s$ does not elapse and the edge pulse $F_P$ is set before the silence flag $F_S$ is set, the counter 110 resets the time t to "0", and starts counting again. It is to be noted that, to prevent overflow, as shown in (I) of FIG. 6, a limiter value is set to the counter 110.

When the silence flag $F_S$ is set, the time t of the counter 110 has an increment from "0". At this time, the silence flag $F_S$ indicates "1", the flag $F_1$ of the first clapping sound described later has a state of an initial value "0", and an input of the edge pulse $F_P$ based on the first clapping sound is waited.

When the edge pulse $F_P$ based on the first clapping sound is input as shown by 501 of FIG. 6(A), it is judged that the edge pulse $F_P$ is "1". The judgment processing circuit 111 sets the flag $F_1$ of the first clapping sound as shown in FIG. 6(D) (logic "1" is assumed) to judge the first clap. The counter 110 sets the time t to "0" again, and the counter 110 starts counting again at rising of the edge pulse $F_P$ as shown in FIG. 6(I).

Subsequently, the silence flag $F_S$ and the flag $F_1$ indicate "1", the flag $F_2$ of the second clapping sound described later has a state of an initial value "0", and an input of the edge pulse $F_P$ based on the second clapping sound is waited. In a case where the edge pulse $F_P$ based on the second clapping sound is input as shown by 502 in (A) of FIG. 6 and it is judged that the edge pulse $F_P$ is "1", the judgment processing circuit 111 judges whether or not a rising time t of the edge pulse $F_P$ satisfies $t \geqq t_1$ and $t < t_1 + t_2$.

That is, the judgment processing circuit 111 judges whether or not the rising time t of the edge pulse $F_P$ based on the second clapping sound falls in the gate 504 (a gate flag $F_G$) for the second clapping sound having the time width $t_2$ shown as (B) in FIG. 6. When the rising time falls in the gate 504, the flag $F_2$ of the second clapping sound is set as shown in (E) of FIG. 6. Moreover, a value (the time) from the rising time of the edge pulse $F_P$ based on the first clapping sound to the rising time t of the edge pulse $F_P$ based on the second clapping sound is stored as an interval period $t_{IN}$ between the first clapping sound and the second clapping sound. The counter 110 resets the time t to t=0 to start counting again.

Subsequently, in a case where the silence flag $F_S$ and the flags $F_1$ and $F_2$ of the clapping sound of the first and second times indicate "1", the flag $F_3$ of the third clapping sound described later has a state of an initial value "0" and the edge pulse $F_P$ based on the third clapping sound is input as shown by 503 in (A) of FIG. 6, the judgment processing circuit 111 judges that the edge pulse $F_P$ is "1". Furthermore, it is judged whether or not the rising time t of the edge pulse $F_P$ based on the third clapping sound satisfies $t \geqq t_{IN}-(t_3/2)$ and $t < t_{IN}+(t_3/2)$.

That is, the judgment processing circuit 111 judges whether or not the rising time t of the edge pulse $F_P$ based on the third clapping sound falls in the gate 505 (the gate flag $F_G$) for the third clapping sound having the time width $t_3$ smaller than the time width $t_2$ shown as (B) in FIG. 6. When the rising time falls in the gate 505, the flag $F_3$ of the third clapping sound is set as shown in (F) of FIG. 6. Furthermore, after the third clapping sound flag $F_3$ is set, the counter 110 resets to t=0 to start counting again. It is to be noted that the gate 505 for the third clapping sound is set so that the pulse rises after elapse of time obtained by subtracting time $t_3/2$ from the interval period $t_{IN}$ from a time when the flag $F_2$ of the second clapping sound rose.

At this time, all of the silence flag $F_S$ and the clapping sound flags $F_1$, $F_2$ and $F_3$ indicates logic "1", and a flag $F_4$ of the fourth clapping sound has a state of an initial value "0". In this state, the time t has an increment. In a case where a state in which the edge pulse $F_P$ is not set continues until $t \geqq t_{IN}+(t_3/2)$ is satisfied, as shown in (G) of FIG. 6, the no-sound flag $F_N$ is set.

The judgment processing circuit 111 sets the no-sound flag $F_N$, and determines that the input of the sound wave into the MC 101 has stopped.

Moreover, all of the silence flag $F_S$, the clapping sound flags $F_1$, $F_2$ and $F_3$ and the no-sound flag $F_N$ is set, and a judgment flag $F_J$ is output for an only certain period $t_F$ as shown in (H) of FIG. 6 in order to satisfy the constitution example of the present embodiment. Here, assuming that the clapping sound for the control is correctly input, a series of judgment operations are completed. After elapse of the certain period $t_F$, the judgment processing section 112 resets all the flags and the count value to "0", and the counter 110 starts counting again to prepare for the next judgment operation.

The judgment operation of the judgment processing section 112 according to the present embodiment has been described above.

It is to be noted that, in a case where a state in which the edge pulse $F_P$ (502) based on the second clapping sound is not input continues for a time ($t_1$+$t_2$), the judgment processing section 112 judges input failure to reset the silence flag $F_S$, the interval period $t_{IN}$ and the first clapping sound flag $F_1$.

Similarly, in a case where a state in which the edge pulse $F_P$ (503) based on the third clapping sound is not input continues for a time $t_{IN}$+($t_3$/2), the input failure is judged to reset the silence flag $F_S$, the interval period $t_{IN}$ and the clapping sound flags $F_1$, $F_2$.

Moreover, after the flag $F_3$ of the third clapping sound is set, the edge pulse $F_P$ is input before the elapse of the time $t_{IN}$+($t_3$/2). In this case, the number of the clapping sounds is larger than the predetermined number. Therefore, the input failure is judged.

According to the present embodiment, the interval period $t_{IN}$ from the time when the first edge pulse 501 corresponding to the first clapping sound is generated until the second edge pulse 502 corresponding to the second clapping sound is generated is reflected during the generation of the gate 505 to detect whether or not the third clapping sound has been generated. Therefore, the gate 505 for the third clapping sound is generated after the elapse of the time obtained by subtracting time of ½ of the time width $t_3$ of the gate 505 for the third clapping sound from the interval period $t_{IN}$ from the time when the second edge pulse 502 was generated.

Although not shown in FIG. 6, in a case where the number of the times to generate the clapping sound is set to four or more, one or a plurality of m (m is an integer of 3 or more and is 1 smaller than n) gates for the detection of fourth and n-th (n is an integer of 4 or more) clapping sounds may be generated in the same manner as in the gate 505 for the third clapping sound. The m gates are generated so that intervals between adjacent gates between the gate 505 for the third clapping sound and the m-th gate to detect whether or not the n-th clapping sound has been generated are a time obtained by subtracting, from the interval period $t_{IN}$, the time of ½ of the time width $t_3$ of the gate 505 for the third clapping sound.

As described above, since the interval period $t_{IN}$ is reflected during the generation of the gate to detect the third and subsequent clapping sounds, the gate for the third clapping sound and the subsequent gates can be regulated so that the adjacent gates (the gate flags $F_G$) for the clapping sounds are generated at equal intervals.

Moreover, in the present embodiment, since the time width $t_2$ of the gate 504 for the second clapping sound is set to be comparatively long, it is possible to cope with user's various clapping paces. Furthermore, since the interval period $t_{IN}$ is reflected, the time width $t_3$ of the gate for the third and subsequent clapping sounds can be set to be smaller than the time width $t_2$. The intervals at which the user generates the clapping sound can be judged by the interval period $t_{IN}$, and even the clapping sound having the smaller time width $t_3$ can sufficiently be detected. Since the time width $t_3$ can be reduced, an erroneous operation due to an unexpectedly emitted clapping sound, an irregularly incoming surrounding noise or the like can be reduced.

The judgment processing section 112 regards, as judgment conditions, the number of the edge pulses $F_P$ based on the series of sound waves detected by the MC 101 and the generation intervals. Furthermore, in a case where more correct judgment is required, the ungenerated state (the silence flag $F_S$) of the sound wave before the generation of the series of the sound waves and the ungenerated state (the no-sound flag $F_N$) of the sound wave after the generation of the series of sound waves are regarded as the judgment conditions.

It is to be noted that judgment conditions including one of the silence flag $F_S$ and the no-sound flag $F_N$ or judgment conditions which do not include the flags may be used. In this case, the judgment operation of the judgment processing section 112 is facilitated.

However, in a case where the silence flag $F_S$ and the no-sound flag $F_N$ are used as the judgment conditions, when the user claps hands as much as the predetermined number of times, the judgment is performed as much as the predetermined number of the times+twice. A burden due to increase of the number of the claps is not imposed on the user, and erroneous judgment operations of the judgment processing section 112 are preferably reduced. Furthermore, the resistance to the sound generated at a surrounding area or the like is preferably improved as compared with a case where the other judgment conditions are used.

Paces at which persons easily clap hands are varied depending on the persons. For example, when a person claps hands at a comparatively slow pace, edge pulses $F_P$ are input at comparatively long intervals as shown by 701 to 703 in (A) of FIG. 7. In consequence, a gate flag $F_G$ (705) for the third clapping sound is generated as shown in (B) of FIG. 7. For example, when a person claps hands at a comparatively high pace, edge pulses $F_P$ are input at comparatively short intervals as shown by 708 to 710 in (C) of FIG. 7, and a gate flag $F_G$ (712) for the third clapping sound is generated as shown in (D) of FIG. 7.

Figure 7:
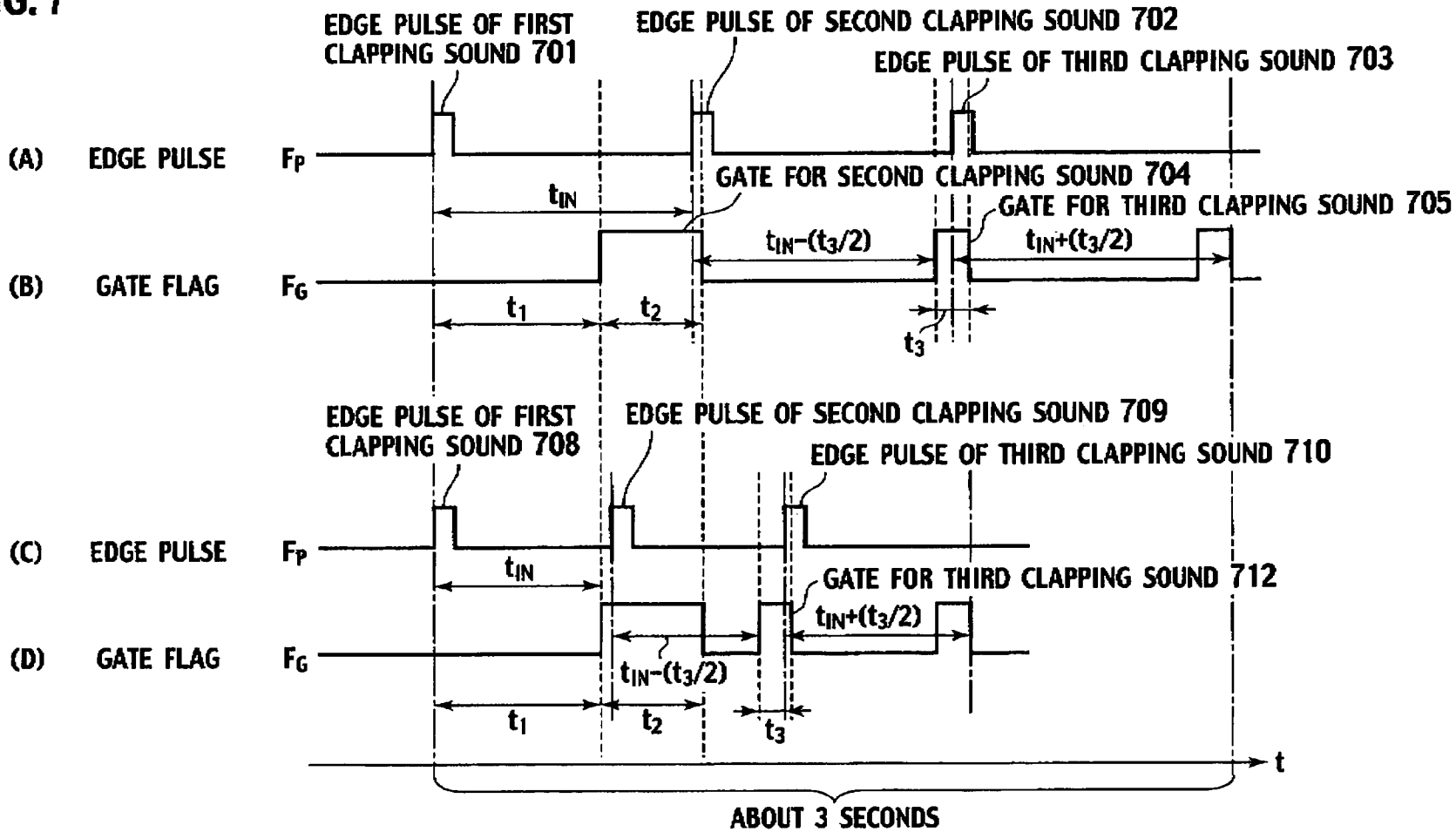
FIG. 7 is a diagram showing that the control method of the first embodiment of the present invention can cope with various clapping intervals.

In either of (A) and (C) of FIG. 7, the interval period $t_{IN}$ between the first clapping sound and the second clapping sound is reflected in a period from a time when the second edge pulse 702 or 709 corresponding to the second clapping sound is generated until the gate 705 or 712 for the third clapping sound rises. Therefore, according to the present embodiment, it is possible to cope with fluctuations of clapping intervals.

However, if any pace is accepted, the erroneous operation is caused. Therefore, a time from the first clap to the last clap may be set to a certain degree. Specifically, in a case where the clapping is performed three times as shown in FIG. 7, $t_1$ and $t_2$ may be set so that correct judgment can be performed, if the first to third claps are generated within about three seconds.

It is to be noted that, in the present embodiment, a case where control is performed in accordance with three claps, but the present invention is not limited to this embodiment. If the number of the claps is increased, the judgment conditions become severe as much as the increase, and the resistance to the erroneous operation improves. However, if the number is set to be excessively large, the user feels troublesome, and failures increase. Therefore, it can be said that three to four claps are appropriate.

Moreover, in a case where the number of the claps is reduced to, for example, two, unlike a case where the number is set to three or more, an algorithm to reflect the interval period $t_{IN}$ cannot be applied. In this case, the resistance to the erroneous operation deteriorates. However, when silence states before and after the generation of the clapping sound are added to the judgment conditions described above, the judgment is performed 2+2 times. A much higher resistance can be obtained as compared with a case where the judgment is performed based on the two claps only.

Figure 8:
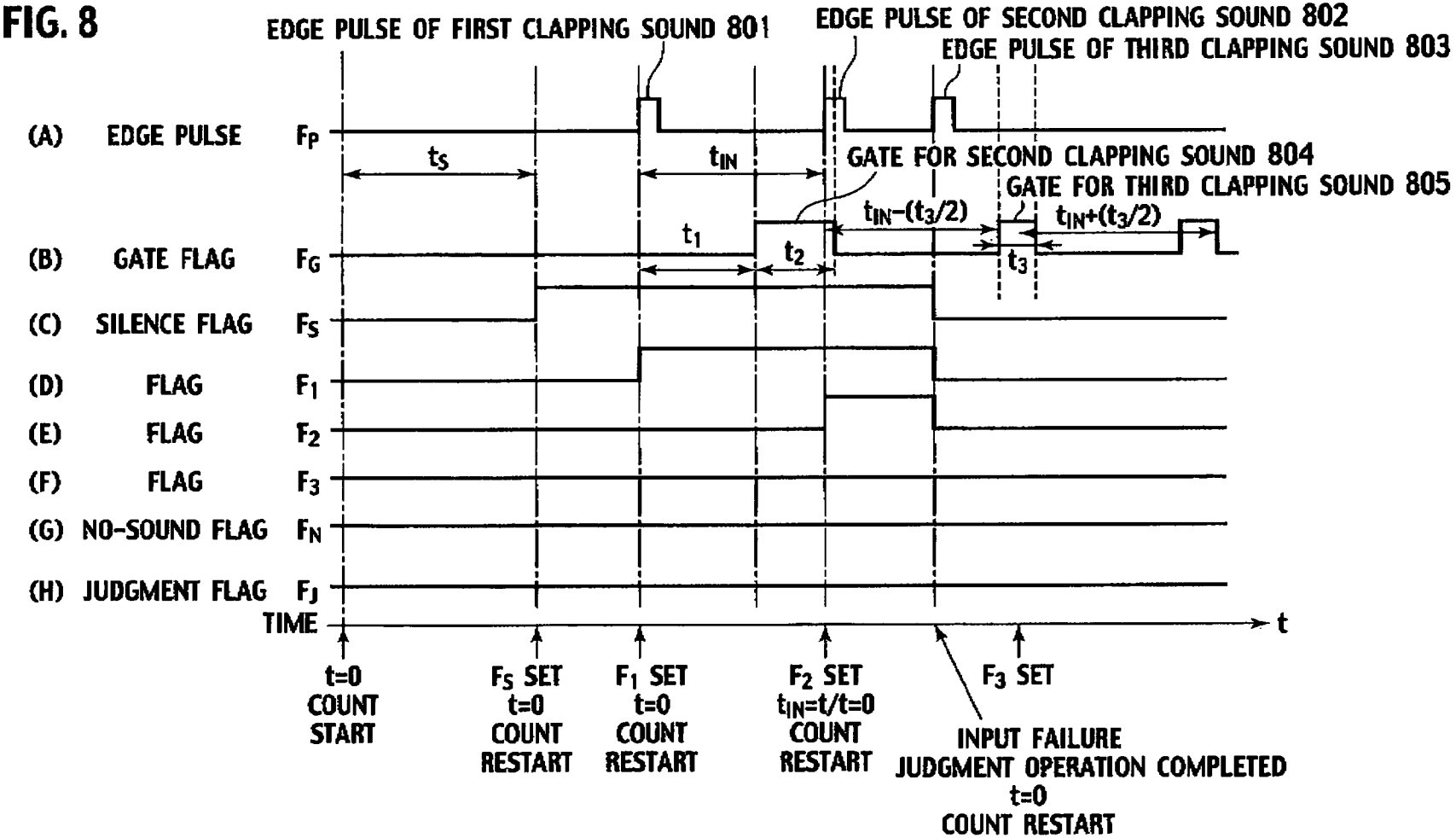
FIG. 8 is a diagram showing an example in which failure is judged in the control method according to the first embodiment of the present invention.

FIG. 8 shows a timing chart in a case where an edge pulse $F_P$ is generated at a period other than a period when a gate flag $F_G$ is set and input fails. The edge pulse $F_P$ based on the first clapping sound is generated as shown by 801 in (A) of FIG. 8, the gate flag $F_G$ for the second clapping sound is generated as shown by 804 in (B) of FIG. 8, and the edge pulse $F_P$ based on the second clapping sound is generated as shown by 802 in (A) of FIG. 8. As shown in (C), (D) and (E) of FIG. 8, a silence flag $F_S$, a flag $F_1$ and a flag $F_2$ are set.

The chart is the same as FIG. 6 up to this point, but the edge pulse $F_P$ based on the third clapping sound shown by 803 in (A) of FIG. 8 is generated outside a gate 805 for the third clapping sound shown as (B) in FIG. 8.

In this case, this sound is regarded as the unexpectedly emitted sound or the surrounding noise, the input fails, and a flag $F_3$ and a no-sound flag $F_N$ are not set as shown in (F) and (G) of FIG. 8. Therefore, the judgment operation ends, and any judgment flag $F_J$ is not output as shown in (H) of FIG. 8. In a case where the operation ends without outputting the judgment flag $F_J$, the judgment processing section 112 resets all the flags and the counter to 0 at this time, and the counter 110 starts counting the time t again to prepare for the next judgment operation start.

That is, in the present embodiment, in a case where the edge pulse $F_P$ is input even once outside the gate period, the input of the clap for the control is regarded as the failure. Therefore, the clapping sound can more correctly be detected.

It is to be noted that in a case where any main body sound is not emitted and when the power supply of the main body turns off, the waveform signal 302 input into the main body sound removal circuit 107 shown in FIGS. 1 and 3 substantially indicates zero or has some noise components. Therefore, the electronic appliance of the present embodiment performs an operation similar to that of an electronic appliance which does not include the main body sound removal circuit 107.

According to the above-mentioned processing, the erroneous operation due to the sound of the main body of the television, an acoustic device or the like can be controlled. Furthermore, even in a case where the main body sound is output from a speaker of the main body and a component of the main body sound is included in the sound input from the microphone, when the clapping sound is larger than the main body sound as much as a certain degree, the clapping sound can be detected, and the control signal is generated based on the detected clapping sound.

Second Embodiment

Figure 9:
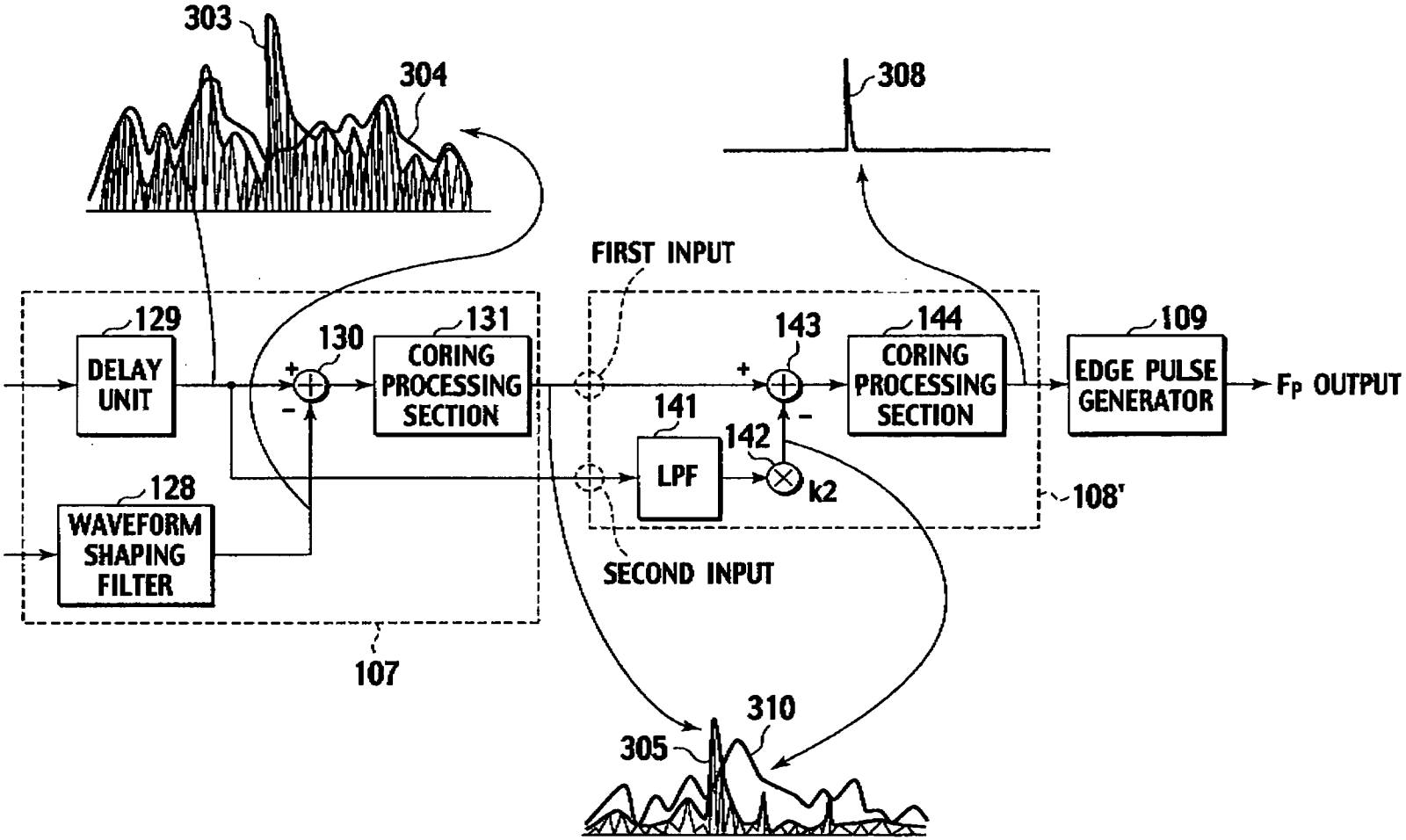
FIG. 9 is a diagram showing processing contents of an edge signal extractor 108' according to a second embodiment of the present invention.

Next, a second embodiment of the present invention will be described. FIG. 9 shows a block diagram of a main part of the second embodiment of an electronic appliance according to the present invention. In the drawing, the same constituting components as those of FIG. 3 are denoted with the same reference numerals, and description thereof is omitted.

In the first embodiment, a waveform signal 305 output from a coring processing section 131 is supplied to an LPF 141, but in the second embodiment, a waveform signal 303 output from a delay unit 129 is supplied to the LPF 141 of an edge signal extractor 108'.

When a main body sound is output from an electronic appliance as a control target, according to the first embodiment, an influence of the main body sound is substantially eliminated, and control with a clapping sound can be performed without causing any erroneous operation. However, when the sound output from a main body speaker 122 is very large, the main body sound is not sufficiently removed in a main body sound removal circuit 107 in rare case. A pulsed noise sometimes remains to such an extent that the noise cannot completely be removed by processing in the edge signal extractor 108 of FIGS. 1 and 3. When the noise is not completely removed, an edge pulse generator 109 might recognize the noise as the clapping sound by mistake.

To solve the problem, in the second embodiment, as described above, a second input supplied to the LPF 141 is formed into the waveform signal 303 output from the delay unit 129, thereby avoiding such a situation.

In FIG. 9, in two inputs for the edge signal extractor 108', as a first input, the waveform signal 305 of the main body sound removal circuit 107 is used in the same manner as in the first embodiment. As the second input, the waveform signal 303 is used instead of the waveform signal 305 of the main body sound removal circuit 107 as described above. The waveform signal 303 is a signal based on a voice signal detected by a microphone 101, and the signal includes a voice signal based on the main body sound emitted from the electronic appliance.

After a high-pass frequency component is decayed by the LPF 141, the waveform signal 303 is multiplied by a constant value k2 by a multiplier 142 to form a waveform signal 310. A subtracter 143 subtracts the waveform signal 310 from the waveform signal 305 on a first input side, and the resultant waveform signal is subjected to coring processing by a coring processing section 144.

In consequence, during the processing in the edge signal extractor 108', not only edge signal extraction processing but also second main body sound removal processing are performed. Therefore, even a pulsed noise having a large amplitude is sufficiently removed, and a resistance to the erroneous operation further improves. However, the clapping sound component to be detected might be removed more than necessary. Therefore, a coefficient value k1 of a multiplier 154 of a waveform shaping filter 128 shown in FIG. 4 and the coefficient value k2 of the multiplier 142 of the edge signal extractor 108' shown in FIG. 9 need to be set to appropriate values.

Third Embodiment

In a case where an electronic appliance is controlled with a clapping sound, when a large noise other than the clapping sound is present at a surrounding area, the clapping sound is buried in a surrounding sound and might not be detected. For example, in a case where music is listened at a high volume, when a sound similar to the clapping sound (in an amplitude value, a frequency band or the like) rings in the music, the sound is recognized as the clapping sound, and an erroneous operation might be caused.

Here, a state in which it might be difficult to control the electronic appliance by claps or the erroneous operation might be caused by such a surrounding sound other than the clapping sound will be referred to as a noise state.

The third embodiment realizes a function of prohibiting the control of the electronic appliance by the claps in a case where it is judged that a state is the noise state.

Since the clapping sound indicates an impulse waveform, the sound has signal components over almost all of the frequency bands. When the input sound is divided into a plurality of bands with a pass filter by use of this characteristic and the respective sounds are subjected to clapping sound detection processing as in the first embodiment, the clapping sound can be distinguished from another sound such as a sound which exists in an only specific band. When the number of the divided bands increases, precision of the distinction improves. Here, the simplest example to divide the band into two bands will be described.

Figure 10:
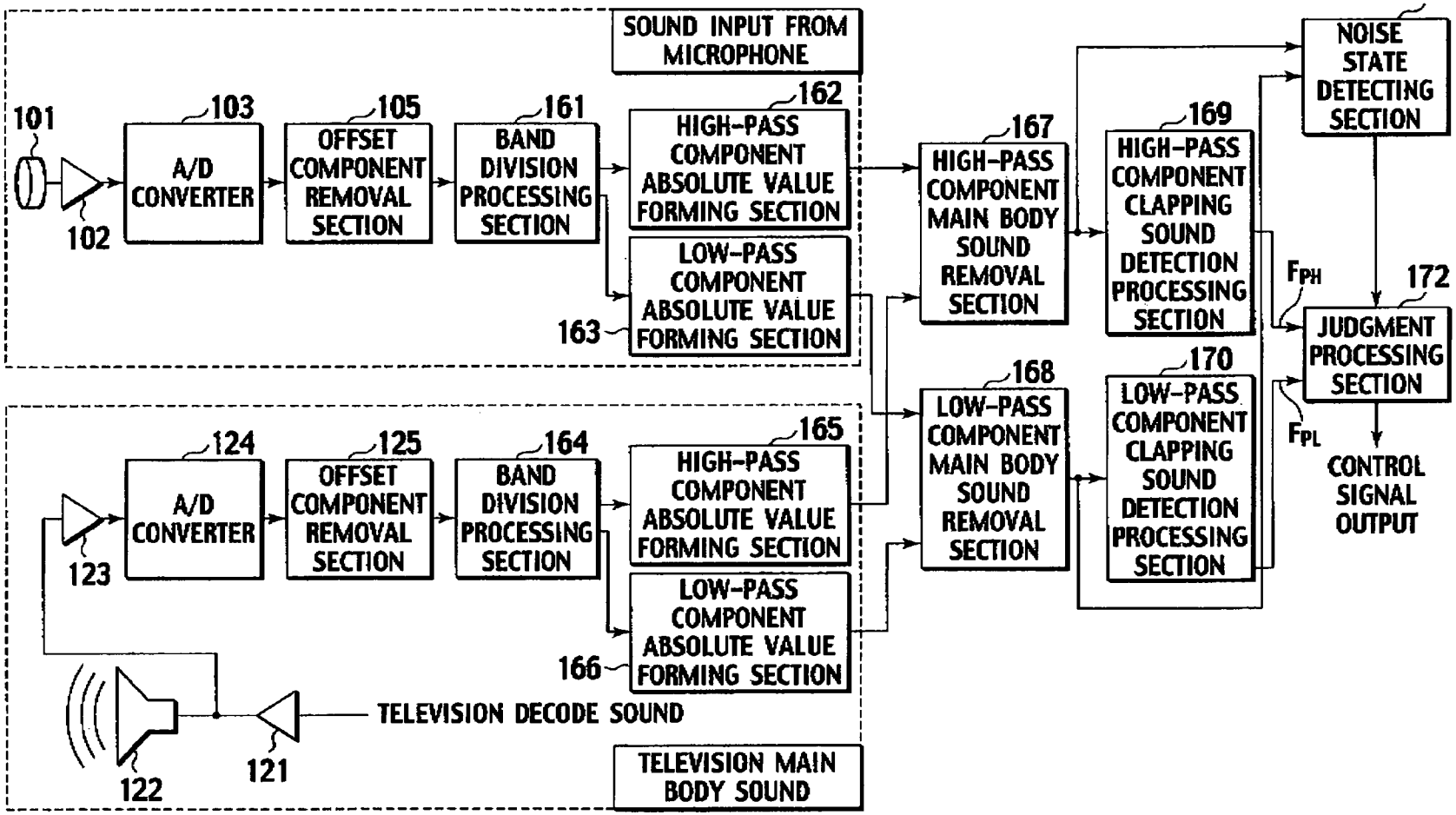
FIG. 10 is a block diagram of an electronic appliance according to a third embodiment of the present invention.

FIG. 10 is a block diagram showing the third embodiment of the electronic appliance according to the present invention. In the drawing, the same constituting components as those of FIG. 1 are denoted with the same reference numerals, and description thereof is omitted. In the first embodiment, absolute value forming circuits 106, 126 are disposed at subsequent stages of offset component removal sections 105, 125, respectively. However, in the third embodiment, at the subsequent stages of the offset component removal sections 105, 125, band division processing sections 161, 164 and subsequent circuit blocks are disposed, respectively.

As shown in FIG. 10, the electronic appliance of the third embodiment includes a high-pass component absolute value forming section 162 and a low-pass component absolute value forming section 163 at the subsequent stage of the band division processing section 161. The apparatus includes a high-pass component absolute value forming section 165 and a low-pass component absolute value forming section 166 at the subsequent stage of the band division processing section 164. Furthermore, the apparatus includes a high-pass component main body sound removal section 167 and a high-pass component clapping sound detection processing section 169 at the subsequent stage of the high-pass component absolute value forming sections 162, 165, and includes a low-pass component main body sound removal section 168 and a low-pass component clapping sound detection processing section 170 at the subsequent stage of the low-pass component absolute value forming sections 163, 166. The apparatus also includes a noise state detecting section 171 and a judgment processing section 172. The judgment processing section 172 has a constitution similar to that of the judgment processing section 112 of the first embodiment.

Digital voice signals output from the offset component removal sections 105, 125, respectively, are divided into two frequency bands by the band division processing sections 161, 164 to constitute a high-pass frequency component and a low-pass frequency component. The band division processing sections 161, 164 have the same constitution, and each section includes, for example, a low-pass filter (LPF) and a subtracter.

The LPF takes and removes the low-pass frequency components (hereinafter referred to as the low-pass components) of signals from which offset components have been removed by the offset component removal sections 105, 125. The subtracter subtracts the low-pass component output from the LPF from the signal from which the offset components output from the offset component removal sections 105, 125 have been removed. Therefore, in the subtracter, the low-pass component of the signal from which the offset component has been removed is decayed. That is, the high-pass frequency component (hereinafter referred to as the high-pass component) provided with a high-pass filter characteristic is output.

It is preferable that the LPFs of the band division processing sections 161, 164 have characteristics that a transition band of the frequency is steep to a certain degree and has little ringing in consideration of detection of rising of an edge based on the clapping sound at the subsequent stage. It is preferable that the LPF is a filter system in which a tap coefficient is as small as possible in order to reduce power consumption and complete processing within a sampling period. For example, a maximum flat half band finite impulse response (FIR) filter is used.

The high-pass components output from the band division processing sections 161, 164 are supplied to the high-pass component absolute value forming sections 162, 165, respectively, to form absolute values. The low-pass components output from the band division processing sections 161, 164 are supplied to the low-pass component absolute value forming sections 163, 166, respectively, to form the absolute values. Two high-pass components formed into the absolute values by the high-pass component absolute value forming sections 162, 165 are supplied to the high-pass component main body sound removal section 167, and two low-pass components formed into the absolute values by the low-pass component absolute value forming sections 163, 166 are supplied to the low-pass component main body sound removal section 168.

The high-pass component main body sound removal section 167 and the low-pass component main body sound removal section 168 have the same constitutions as a constitution of the main body sound removal circuit 107 shown in FIG. 1. However, the constitutions are different in that an input signal is the high-pass component or the low-pass component. The high-pass component main body sound removal section 167 and the low-pass component main body sound removal section 168 remove a main body sound component included in the input signal (the high-pass component, the low-pass component) by processing similar to that in the main body sound removal circuit 107.

The high-pass component (a high-pass component absolute value) from which the main body sound component has been removed is supplied from the high-pass component main body sound removal section 167 to the high-pass component clapping sound detection processing section 169, and the high-pass component clapping sound detection processing section detects the clapping sound from the component to generate an edge pulse $F_{PH}$ of the high-pass component. On the other hand, the low-pass component (a low-pass component absolute value) from which the main body sound component has been removed is supplied from the low-pass component main body sound removal section 168 to the low-pass component clapping sound detection processing section 170, and the low-pass component clapping sound detection processing section detects the clapping sound from the component to generate an edge pulse $F_{PL}$ of the low-pass component.

Each of the high-pass component clapping sound detection processing section 169 and the low-pass component clapping sound detection processing section 170 includes the edge signal extractor 108 and the edge pulse generator 109 shown in FIG. 1, and operations of the extractor and the generator have been described above, and hence description thereof is omitted.

The noise state detecting section 171 of FIG. 10 judges whether or not a continuous large sound other than the clapping sound is present at a surrounding area, based on one or both of the high-pass component absolute value output from the high-pass component main body sound removal section 167 and the low-pass component absolute value output from the low-pass component main body sound removal section 168. The noise state detecting section then outputs a judgment result to the judgment processing section 172. The judgment processing section 172 includes a counter and a judgment processing circuit substantially in the same manner as in the judgment processing section 112 shown in FIG. 1.

Here, the noise state detecting section 171 performs one of the following operations.

(1) An appropriate threshold value is set with respect to the low-pass component absolute value to detect the noise state with the only low-pass component.

(2) An appropriate threshold value is set with respect to the high-pass component absolute value to detect the noise state with the only high-pass component.

(3) Appropriate threshold values are set with respect to the low-pass component absolute value and the high-pass component absolute value to detect the noise state with the respective components, and the noise state is determined at a time when one or both of the components is detected as the noise state (the detection of one/both of the components is reflected in severity of the judgment).

(4) Noise state detection target values (values formed into the absolute values) of the low-pass component and the high-pass component are added up or multiplies by a certain ratio and added up (e.g. $\alpha\times$low-pass component absolute value+$\beta\times$high-pass component absolute value), and an appropriate threshold value is set with respect to this resultant value to judge the noise state.

Figure 11:
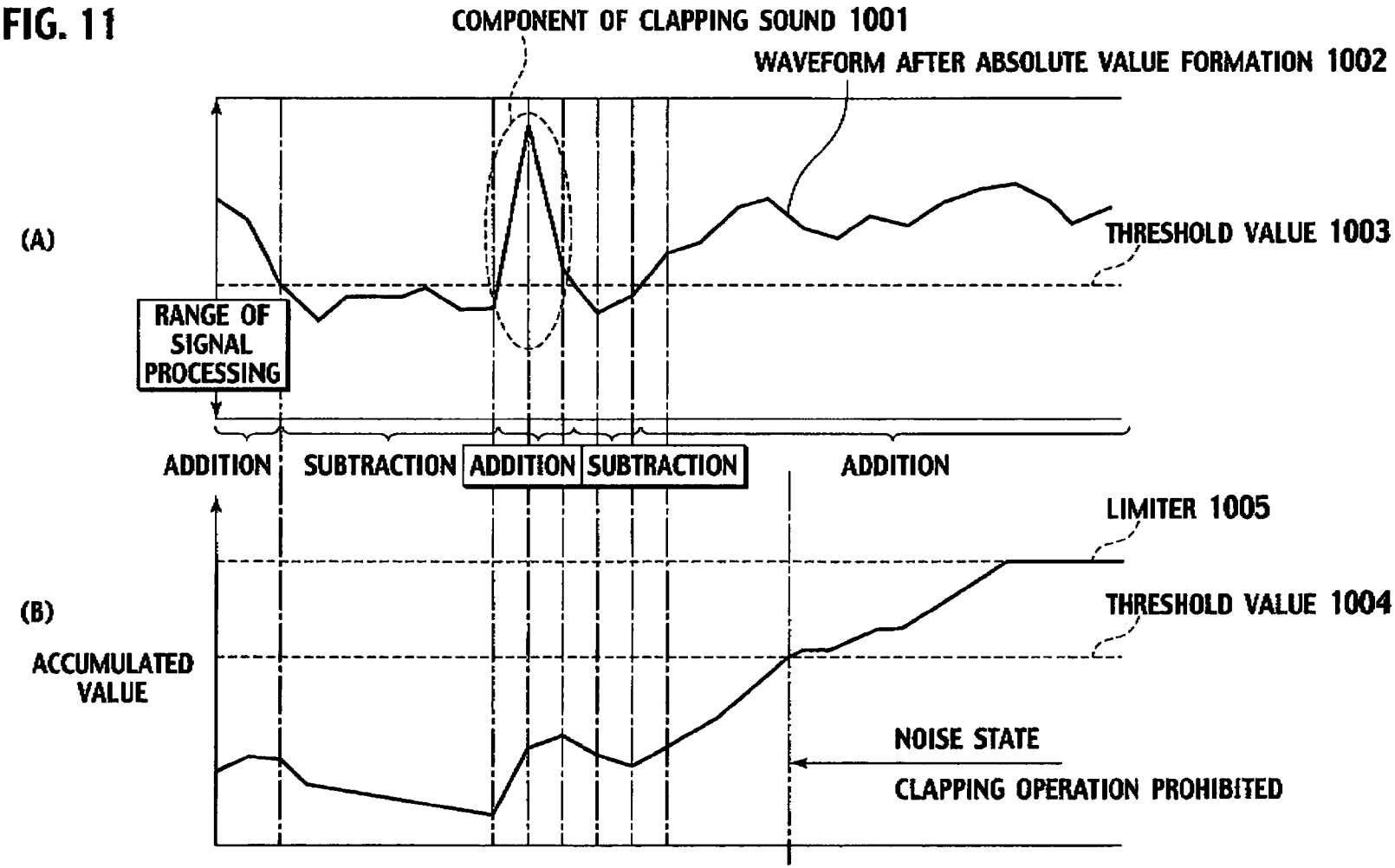
FIG. 11 is an explanatory view of an operation of a noise state detecting section 171 shown in FIG. 10.

Next, a detecting operation of the noise state detecting section 171 will be described also with reference to FIG. 11. Waveform (A) of FIG. 11 shows a behavior of a waveform signal 1002 to be supplied to the noise state detecting section 171 after the absolute value formation in the noise state. A component 1001 of the clapping sound in the input waveform signal 1002 is buried in a component formed by the noise state, and it is difficult to detect the clapping sound component by the processing of the first embodiment.

To solve the problem, in the present embodiment, as shown in FIG. 11, an appropriate threshold value 1003 is first set with respect to the waveform signal 1002. Moreover, the threshold value 1003 is subtracted from a value of the waveform signal 1002 to obtain a variable, and such variables are accumulated to obtain a variable sum. When the value of the waveform signal 1002 is less than the threshold value 1003, addition of a negative value, that is, subtraction from the variable sum is performed.

Since a value larger than the threshold value 1003 is input in a region shown as addition in (A) of FIG. 11, a difference between the value and the threshold value 1003 is added to the variable sum. Since the input value is smaller than the threshold value 1003 in a region shown as subtraction in the drawing, the difference is subtracted from the variable sum. The variable sum at this time is shown in (B) of FIG. 11.

Subsequently, an appropriate threshold value 1004 is provided even with respect to the variable sum. In a state in which the variable sum is larger than this threshold value 1004, the noise state detecting section 171 regards this state as the noise state, and outputs a clap control prohibition flag $F_F$ to the judgment processing section 172. Here, when the value of the waveform signal 1002 continues to exceed the threshold value 1003, the variable sum continues to be added. Therefore, to prevent overflow, a limiter 1005 is provided with respect to the variable sum as shown in (B) of FIG. 11. A lower limit value of the variable sum is set to 0.

When the clap control prohibition flag $F_F$ is not input, the judgment processing circuit of the judgment processing section 172 of FIG. 10 performs a judgment operation similar to that of the judgment processing circuit 111 of the first embodiment. On the other hand, when the clap control prohibition flag $F_F$ is input, a judgment operation is stopped to prohibit the clap control. In consequence, the erroneous operation due to the surrounding noise is prevented. When the clap control prohibition flag $F_F$ is set, a predetermined display may be displayed in a screen or a predetermined voice may be generated from a speaker so that a user can recognize a state in which the clap control is not accepted.

When the value of the waveform signal 1002 is level-sliced to perform judgment in FIG. 11, the clap control prohibition flag $F_F$ is set by the clapping sound itself, because the component of the clapping sound has a large amplitude during rising. However, the judgment is performed using the variable sum which is an accumulated value of the values of the waveform signal 1002, instead of the value of the waveform signal 1002, as in the present embodiment. In consequence, the clap control prohibition flag $F_F$ can be set with respect to continuous large surrounding sounds only.

FIG. 12 shows one example of evaluation in a case where an electronic appliance is controlled by clapping hands three times, "○" indicates a case where each edge pulse is detected in a gate period, and "x" indicates a case where any edge pulse is not detected.

In the example of FIG. 12, the high-pass edge pulse $F_{PH}$ based on the second clap cannot be detected, but the low-pass edge pulses $F_{PL}$ based on all claps can be detected. Here, in a method of the evaluation, the first clap is regarded as start. To avoid erroneous detection is regarded as important, and a logical product of both of the high-pass edge pulse $F_{PH}$ and the low-pass edge pulse $F_{PL}$ is calculated as a calculation result of the first clap.

On the other hand, a logical sum of the high-pass edge pulse $F_{PH}$ and the low-pass edge pulse $F_{PL}$ is taken to calculate the calculation result of the second clap and the third clap. Moreover, in first evaluation, it is confirmed that the calculation result of the edge pulses based on first to third clapping sounds exists. In second evaluation, sum of the number of times of detection of the edge pulses $F_{PH}$, $F_{PL}$ during the second and third claps is evaluated. When the edge pulses $F_{PH}$ and $F_{PL}$ are completely detected, the number of the detection times is four. Here, to improve a recognition ratio, if the number of the detection times is three or more, recognition is determined. Such processing is performed to improve a resistance to erroneous recognition.

For example, an electronic sound or the like referred to as a beep sound, for example, a warning sound of the electronic appliance or the like has a specific frequency component. Therefore, for example, when the beep sound is repeated three times, the edge pulse is detected and cannot be distinguished in the same manner as in the claps. Even when such a case is assumed, according to the evaluation method of FIG. 12, the logical product is obtained as described above once among all of the three claps. Therefore, both of the high-pass edge pulse $F_{PH}$ and the low-pass edge pulse $F_{PL}$ need to rise simultaneously, and the erroneous recognition of an electronic sound such as the beep sound can be avoided. Since an electronic sound such as the beep sound has a specific frequency component, both of the high-pass edge pulse $F_{PH}$ and the low-pass edge pulse $F_{PL}$ do not rise simultaneously.

It is to be noted that the method of the evaluation is not limited to the method shown in FIG. 12, and severe evaluation may be performed so that a calculation content of all the claps is the logical product of the high-pass edge pulse $F_{PH}$ and the low-pass edge pulse $F_{PL}$.

Moreover, assuming that the calculation content of all the claps is the logical sum of the high-pass edge pulse $F_{PH}$ and the low-pass edge pulse $F_{PL}$, the sum of the detection times of the edge pulses may be evaluated. It is preferable that a purpose of improving precision of the detection or the resistance to the erroneous recognition is set in accordance with environments.

When the clap control prohibition flag $F_F$ is not input from the noise state detecting section 171, the judgment processing section 172 performs a judgment operation similar to that of the judgment processing circuit 111 of the first embodiment. On the other hand, when the clap control prohibition flag $F_F$ is input, a judgment operation is stopped to prohibit the clap control. In consequence, the erroneous operation due to the surrounding noise is prevented. When the clap control prohibition flag $F_F$ is set, a predetermined display may be displayed in a screen or a predetermined voice may be generated from a speaker so that a user can recognize a state in which the clap control is not accepted.

Since the clap control prohibition flag $F_F$ is introduced as described above, it is possible to prevent the erroneous operation in a case where the continuous large noise exists as shown in (A) of FIG. 11. Furthermore, with the display or the like by which the user can recognize the prohibited state, the user does not have to clap hands uselessly in a state in which the clap control cannot be performed. Moreover, if, for example, music is a cause of the noise, a countermeasure can be taken, for example, the music is stopped.

Fourth Embodiment

Next, a fourth embodiment of the present invention will be described. In the first embodiment, a control method (a judgment processing algorithm) of a judgment processing section 112 to judge the only predetermined number of claps (three claps in the first embodiment) has been described. However, if the judgment can be performed with respect to the only predetermined number of the claps, only one type of control can be performed, when the control of an electronic appliance by this clapping sound is actually performed and even if the control is varied in accordance with a state of the electronic appliance. This is a large restriction on the use of the present invention.

When the several types of the number of the claps are distinguished and a control operation can be set in accordance with the number of the claps, the use is broadened. Therefore, in the present embodiment, a control method to judge several types of the number of the claps will be described.

Figures 13, 14:
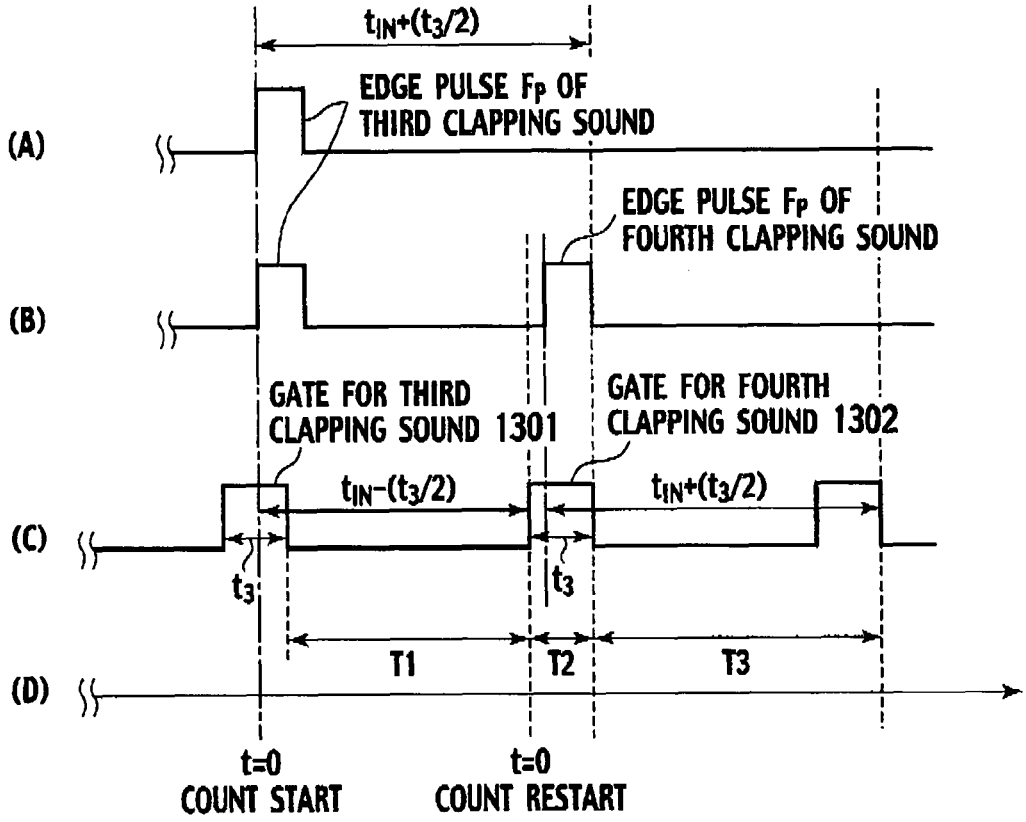
FIG. 13 is a timing chart explaining a control method according to a fourth embodiment of the present invention.
FIG. 14 is an explanatory view explaining conditions of judgment performed by an electronic appliance according to the fourth embodiment of the present invention.

FIG. 13 shows a control method to judge three claps and four claps as one example of the present embodiment. Diagram (A) of FIG. 13 shows edge pulses $F_P$ in a case where the electronic appliance is controlled with the three claps, and diagram (B) of FIG. 13 shows edge pulses $F_P$ in a case where the apparatus is controlled with the four claps. The control method in a state in which input of the third clap is completed, that is, in a state in which a silence flag $F_S$ and clapping sound flags $F_1$ to $F_3$ shown in FIG. 6 are set is the same as that of the first embodiment. Therefore, description and drawing thereof are omitted. An operation of the judgment processing section 112 (or 172) after output of the edge pulse $F_P$ based on the third clapping sound will be described.

As shown in (A) of FIG. 13, when a judgment processing circuit 111 detects the edge pulse $F_P$ based on the third clapping sound in a gate 1301 of the third clapping sound shown in (C) of FIG. 13, a counter 110 starts counting again at t=0. Subsequently, when any edge pulse $F_P$ is not generated within a period of T1 and T2 ($t<t_{IN}+(t_3/2)$) shown in (C) of FIG. 13 and $t\geqq t_{IN}+(t_3/2)$ is satisfied, the above-mentioned judgment conditions of the three claps are satisfied, and the input becomes successful. This has been described in the first embodiment.

On the other hand, in a case where the edge pulse $F_P$ is detected within the period of T1 and T2 ($t<t_{IN}+(t_3/2)$) of (C) of FIG. 13, a condition that any edge pulse $F_P$ is not detected for a predetermined period after the third clap is not satisfied. Therefore, the control by three claps fails.

In a case where the clapping is performed four times as shown in (B) of FIG. 13, when the edge pulse $F_P$ based on the third clapping sound is detected in the gate 1301 of the third clapping sound shown in (C) of FIG. 13 in the same manner as in (A) of FIG. 13, the counter 110 starts counting again at t=0. Subsequently, the judgment processing circuit 111 generates a gate 1302 to detect whether or not the fourth clapping sound has been generated, after elapse of a predetermined time $t_{IN}-(t_3/2)$ from the time t when the edge pulse $F_P$ based on the third clapping sound is generated by an edge pulse generator 109.

Here, a case where the edge pulse $F_P$ based on the fourth clapping sound is generated in a period of T1 to T3 shown in (C) of FIG. 13 will be described.

First, when the edge pulse $F_P$ based on the fourth clapping sound is generated in a period T1 ($t<t_{IN}-(t_3/2)$) outside the gate 1302, the control by four claps fails.

In a case where the edge pulse $F_P$ based on the fourth clapping sound is generated in a period T2 which satisfies $t\geqq t_{IN}-(t_3/2)$ and $t<t_{IN}+(t_3/2)$ within the gate 1302, the judgment processing circuit 111 detects that a sound wave based on the fourth clapping sound has been generated. It is confirmed that any edge pulse $F_P$ is not generated until a period T3 of $t_{IN}+(t_3/2)$ elapses from the time t when the edge pulse $F_P$ based on the fourth clapping sound is generated, judgment conditions of the four claps are satisfied, and the control by the four claps becomes successful.

It is to be noted that, even when the edge pulse $F_P$ based on the fourth clapping sound is generated in the period T3 outside the gate 1302, the control by the four claps fails. The period of $t_{IN}+(t_3/2)$ has already elapsed from the time t when the edge pulse $F_P$ based on the third clapping sound was generated. Therefore, even if the fourth sound wave is input, the sound wave is not recognized.

In a case where it is set that the electronic appliance is controlled by three or four claps as in this example, the judgment conditions of the third clap are satisfied as described above, the control is judged to be performed by the three claps.

As described above, the judgment conditions of the three clapping sounds and four clapping sounds have been considered separately. The judgment conditions are summarized as shown in FIG. 14. In FIG. 14. "○" indicates that the edge pulse $F_P$ is set once in the period, "x" indicates that the edge pulse $F_P$ is not set even once in the period, and "-" indicates that there is not any relation.

In a case where the edge pulse $F_P$ is set in the period T1, the case does not agree with either of the judgment conditions for the three claps and the four claps. Therefore, input failure results. When any edge pulse $F_P$ is not set in the period T2, it is judged that three claps have been made. When the edge pulse $F_P$ is set in the period T2, there is not any possibility that the three claps have been made. Furthermore, in a case where the edge pulse $F_P$ is set in the period T2 and the edge pulse $F_P$ is not set in the period T3, it is judged that four claps have been made.

When the above-mentioned judgment operation is realized, the three claps can be distinguished from the four claps. Since this judgment method does not theoretically limit the number of the claps and the type of the number of the claps, the method can broadly be applied. That is, it is possible to distinguish three or more types of the number of the claps.

Specific Examples

As specific examples in which an electronic appliance is controlled by a clapping sound according to each embodiment of the present invention described above, FIG. 15 shows one example in which a television receiver (hereinafter referred to as the television) is controlled. In the drawing, the same constituting parts as those of FIGS. 1, 2 and 10 are denoted with the same reference numerals.

Figure 15:
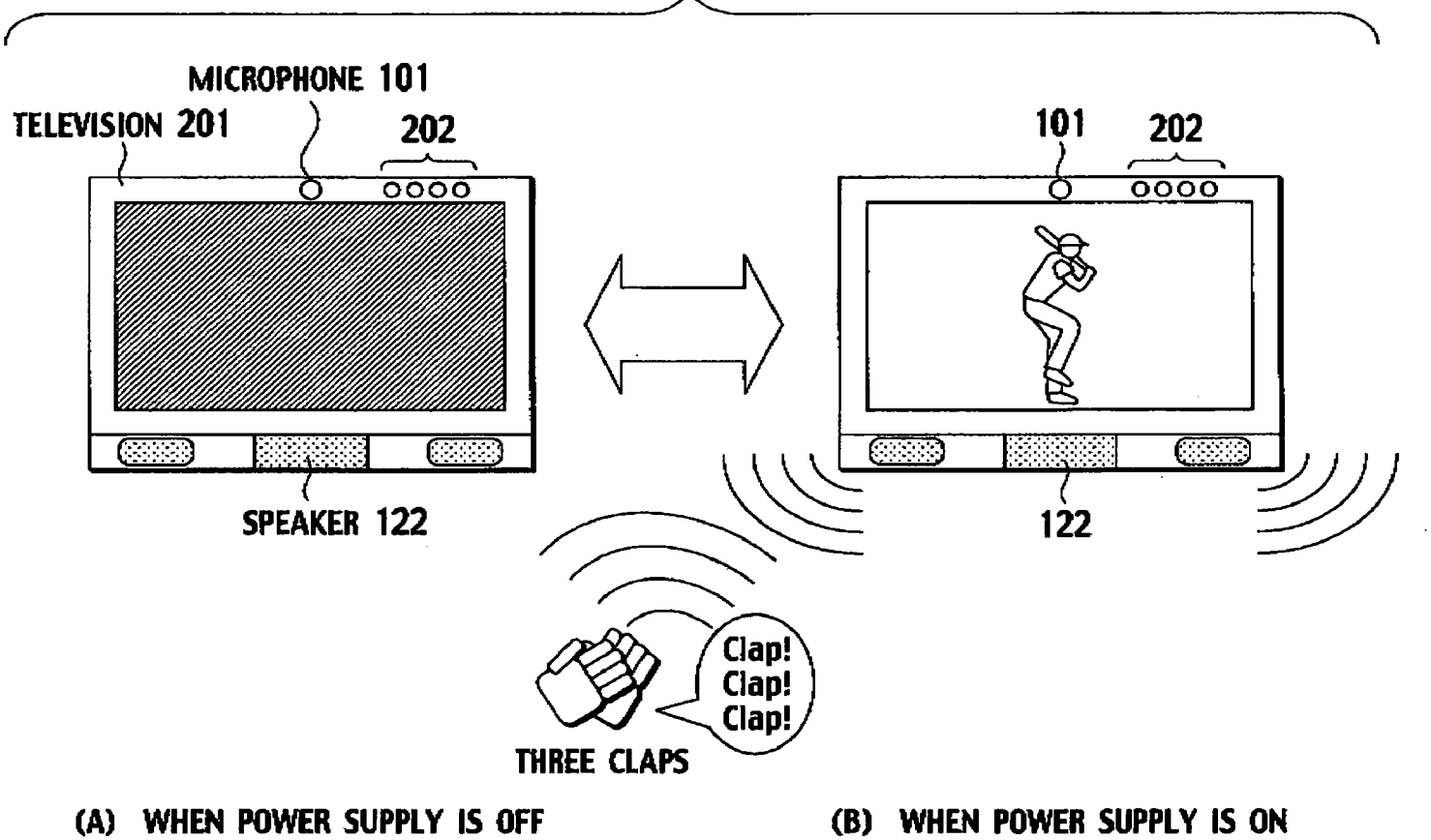
FIG. 15 is an explanatory view of a specific example in which turning on/off of a power supply of television is controlled according to the present invention.

Diagram (A) of FIG. 15 shows a television 201 at a time when a power supply turns off, and diagram (B) of FIG. 15 shows the television at a time when the power supply turns on. A microphone 101 is disposed at an upper portion of a front surface of the television 201, and a main body speaker 122 is disposed at a lower portion of the front surface. Moreover, indicators 202 including a plurality of light emitting diodes (LED) having different emitted colors are disposed adjacent to the microphone 101. The indicators 202 indicate a state of a sound input from the microphone 101 with respect to a user at present.

It is preferable to install the microphone 101 at a position where the clapping sound can be picked well. The microphone may be installed at the center of the upper portion of the television 201 as shown in (A) and (B) of FIG. 15, or may be installed at another place. However, a frequency component and an amplitude of a main body sound turned to the microphone 101 differ with a distance between the main body speaker 122 and the microphone 101, angles and use environments thereof, and parameters for removal of the main body sound might change. Therefore, it is preferable that the position of the microphone 101 is not varied, and is fixed.

In a case where control by three claps is assigned to turning on/off of the power supply of the electronic appliance, it is expected that an erroneous operation or obstruction of operation control due to the main body sound occurs at a time when the power supply turns on as shown in (B) of FIG. 15. To solve this problem, there is an only method in which the user sacrifices convenience. For example, the clap control is prohibited in a case where a volume of the sound input into the microphone 101 exceeds a set threshold value at a time when the power supply turns on.

However, according to the present invention, even when the power supply is turned off as shown in (A) of FIG. 15 or turned on as shown in (B) of FIG. 15, the main body sound is removed by a main body sound removal circuit 107 and main body sound removal sections 167, 168. Therefore, the user does not have to be aware of a difference between a state where the power supply is turned on and a state where the power supply is turned off, and the power supply can be controlled by the clapping sound in the same manner.

Moreover, usually in the electronic appliance, when the power supply is turned off, a microcomputer disposed in the apparatus is brought into a state referred to as a standby state or a stop mode. As compared with a usual operation, a clock frequency is reduced, or supply of clock is stopped. It is difficult to perform the processing described above by software in this state. For example, all the processing needs to be performed by hardware, and a signal needs to be input as an interruption signal into the microcomputer.

Figure 16:
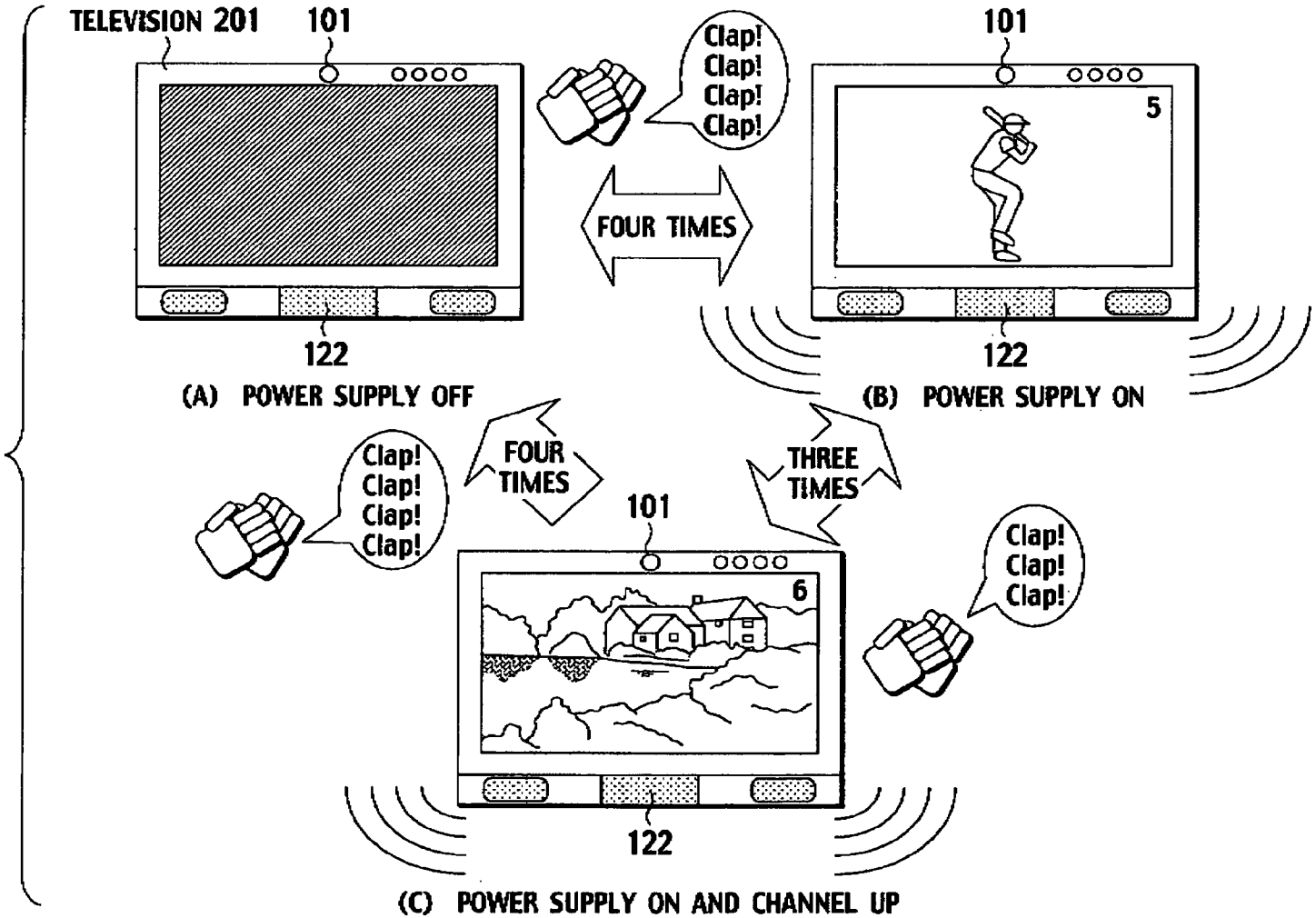
FIG. 16 is an explanatory view of a specific example in which the television is controlled in different manners according to the present invention.
Figure 17:
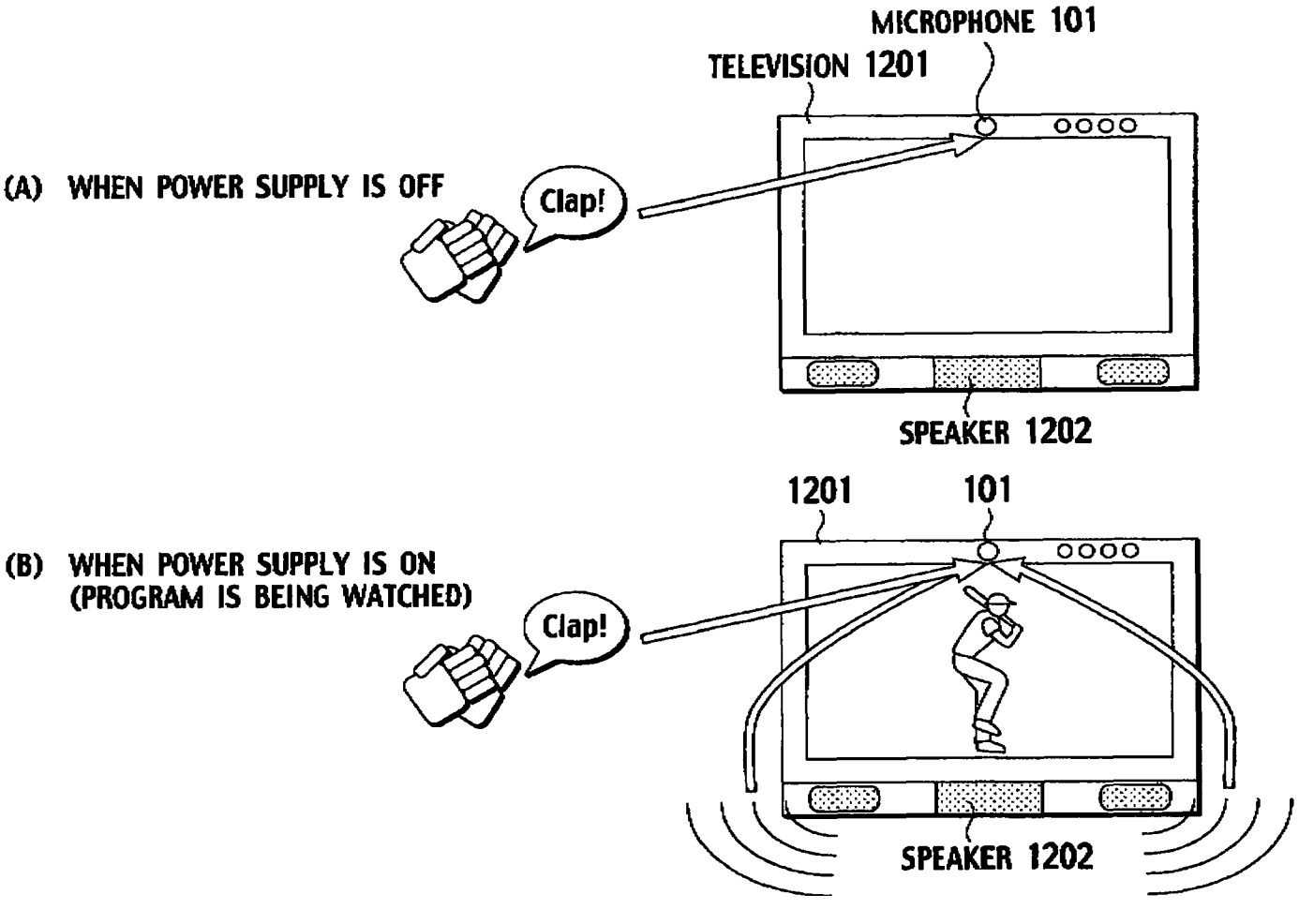
FIG. 17 is an explanatory view showing a problem in a case where the television is controlled with claps.

FIG. 16 shows an example of a case where the different numbers of the claps are assigned to separate control operations with respect to the control of the television 201. In the drawing, the same constituting parts as those of FIG. 15 are denoted with the same reference numerals, and description thereof is omitted. In this example, four claps are assigned to the turning on/off of the power supply, and three claps are assigned to channel-up.

Therefore, in a case where the user claps hands four times in a state in which the power supply of the television 201 is turned off as shown in (A) of FIG. 16, the electronic appliance incorporated in the television 201 according to the present invention identifies the four clapping sounds to obtain a control signal which allows the state to shift to a state in which the power supply is turned on as shown in (B) of FIG. 16. In a case where the user claps hands four times in a state in which the power supply of the television 201 is turned on as shown in (B) of FIG. 16, the state shifts to the state in which the power supply of the television 201 is turned off as shown in (A) of FIG. 16.

Moreover, in a case where the user claps hands three times in a state in which the power supply of the television 201 is turned on as shown in (B) of FIG. 16, a channel of the television 201 being watched is switched upwards to the next channel, and the television is operated and controlled so as to receive the changed channel as shown in (C) of FIG. 16.

In consequence, to perform different control operations in accordance with the number of the claps, the constitution of the fourth embodiment described with reference to FIGS. 13 and 14 is required. When this embodiment is applied, the control by the clapping sound can be performed without being influenced by the main body sound even at a time when television is watched.

As described above, according to the use of the electronic appliances of the first to fourth embodiments and the voice signal processing methods of the apparatuses, the electronic appliance can be controlled by the clapping sound without being influenced by the main body sound. It is to be noted that in the first to fourth embodiments, the judgment of the three or more claps has been described, but even one clap or two claps can be used in the control of the electronic appliance. However, with the claps less than the three claps, the number of the judgments is simply reduced. In addition, a control method to reflect the interval period between the first clap and the second clap in the next interval period as described in the first embodiment cannot be applied. Therefore, erroneous operations largely increase as compared with the three or more claps. Therefore, as described above in the embodiments, the three or more claps are said to be more realistic.

It is to be noted that, in the above embodiments, the case where the electronic appliance is controlled in accordance with the clapping sounds generated by the user (the operator) has been described, but the present invention is not limited to this case. The user may generate the predetermined number of sound waves for the control of the electronic appliance, and a sound wave generation method other than the claps (e.g., a hit sound emitted at a time when the user hits a desk or the like at the closest position with a hand-held object, etc.) is also included in the present invention.

Furthermore, a computer program which operates the CPU 104 by software to realize the above embodiments is also included in the present invention. This computer program may be taken from a recording medium to a computer, or distributed and downloaded to the computer via a communication network.

More generally, it should be understood that many modifications and adaptations of the invention will become apparent to those skilled in the art and it is intended to encompass such obvious modifications and changes in the scope of the claims appended hereto.

What is claimed is:

1. An electronic appliance comprising:

a speaker which subjects a first voice signal generated from the electronic appliance to electricity-sound conversion to output a converted first sound wave;

a sound detector which detects a second sound wave where a specific sound wave generated for control of the electronic appliance is superimposed on a third sound wave based on the first sound wave emitted from the speaker and which subjects the second sound wave to sound-electricity conversion to output a second voice signal, wherein the third sound wave is originally the same signal as the first sound wave but having different component and amplitude owing to a transmission characteristic along a path from the speaker to the sound detector;

a first waveform generator which subjects the first voice signal to predetermined signal processing to generate a first waveform signal;

a second waveform generator which subjects the second voice signal output from the sound detector to predetermined signal processing to generate a second waveform signal;

a waveform shaping unit which enlarges the first waveform signal in a time axis direction to output a third waveform signal;

a subtracter which subtracts the third waveform from the second waveform signal to output a fourth waveform signal of the specific sound wave;

wherein the first waveform generator includes a first offset component removal section to generate a voice signal, and a first absolute value forming circuit which forms an absolute value of the voice signal output from the first offset component removal section to output the first waveform signal, and the second waveform generator includes a second offset component removal section to generate a voice signal in which an offset component is removed from the second voice signal, and a second absolute value forming circuit which forms an absolute value of the voice signal output from the second offset component removal section to output the second waveform signal.

2. The electronic appliance according to claim 1, wherein the waveform shaping unit includes a plurality of retaining units which retain the first waveform signals for a predetermined time, and an extractor which extracts maximum values of the plurality of first waveform signals output from the plurality of retaining units and which synthesizes the plurality of extracted maximum values in time series to generate the third waveform signal.

3. A voice signal processing method comprising:

an electricity-sound conversion step of subjecting a first voice signal generated from an electronic appliance to electricity-sound conversion to output a first sound wave by a speaker;

a sound detecting step of detecting a second sound wave in which a specific sound wave generated for control of the electronic appliance is superimposed on a third sound wave based on the first sound wave emitted from the speaker by a sound detector, wherein the third sound wave is originally the same signal as the first sound wave but having different component and amplitude owing to a transmission characteristic along a path from the speaker to the sound detector;

a sound-electricity conversion step of subjecting the second sound wave to sound-electricity conversion to output a second voice signal;

a first waveform generation step of subjecting the first voice signal to predetermined signal processing to generate a first waveform signal;

a second waveform generation step of subjecting the second voice signal to predetermined signal processing to generate a second waveform signal;

a waveform shaping step of enlarging the first waveform signal in a time axis direction to output a third waveform signal;

a subtraction step of Subtracting the third waveform signal from the second waveform signal to output a fourth waveform signal of the specific sound wave;

wherein the first waveform generation step includes a first offset component removal step of generating a voice signal in which an offset component is removed from the first voice signal, and a first absolute value forming step of forming an absolute value of the voice signal output in the first offset component removal step to output the first waveform signal, and the second waveform generation step includes a second offset component removal step of generating a voice signal in which an offset component is removed from the second voice signal, and a second absolute value forming step of forming an absolute value of the voice signal output in the second offset component removal step to output the second waveform signal.

4. The voice signal processing method according to claim 3, further comprising:

a retaining step of retaining the plurality of first waveform signals for a predetermined time, respectively; and an extraction step of extracting maximum values of the plurality of first waveform signals and synthesizing the plurality of extracted maximum values in time series to generate the third waveform signal.

* * * * *